US012466614B1

(12) United States Patent
Glucksman et al.

(10) Patent No.: US 12,466,614 B1
(45) Date of Patent: Nov. 11, 2025

(54) CAP AND TWO-PART PLUG ASSEMBLY FOR A DRIP-PROOF SPOUT

(71) Applicant: Steuben Foods, Inc., Elma, NY (US)

(72) Inventors: Dov Glucksman, Mattapoisett, MA (US); Rodney Glenn Wright, Sarasota, FL (US); Marc Drucker, Milton, MA (US); David T. Stephenson, Buffalo, NY (US)

(73) Assignee: Steuben Foods, Inc., Elma, NY (US)

( * ) Notice: Subject to any disclaimer, the term of this patent is extended or adjusted under 35 U.S.C. 154(b) by 200 days.

(21) Appl. No.: 18/374,480

(22) Filed: Sep. 28, 2023

Related U.S. Application Data

(60) Provisional application No. 63/410,863, filed on Sep. 28, 2022.

(51) Int. Cl.
*B65D 41/04* (2006.01)
*B65D 47/08* (2006.01)
*B65D 47/12* (2006.01)

(52) U.S. Cl.
CPC ..... *B65D 41/0414* (2013.01); *B65D 47/0804* (2013.01); *B65D 47/123* (2013.01); *B65D 2251/0025* (2013.01); *B65D 2251/0078* (2013.01); *B65D 2547/06* (2013.01)

(58) Field of Classification Search
CPC ..... B65D 41/0414; B65D 47/0804; B65D 47/123; B65D 2251/0025; B65D 2251/0078; B65D 2547/06
See application file for complete search history.

(56) References Cited

U.S. PATENT DOCUMENTS

| | | | | |
|---|---|---|---|---|
| 5,931,352 | A | 8/1999 | Dirr | |
| 6,257,463 | B1 | 7/2001 | De Polo | |
| 6,336,571 | B1 * | 1/2002 | Chibret | A61F 9/0008 222/189.09 |
| 9,751,677 | B2 | 9/2017 | Fiere et al. | |
| 10,035,614 | B2 | 7/2018 | van der Meijden et al. | |
| 10,370,165 | B2 | 8/2019 | Fiere et al. | |
| 11,167,903 | B2 | 11/2021 | Murray et al. | |
| 2022/0055815 | A1 | 2/2022 | Fiere | |

FOREIGN PATENT DOCUMENTS

| | | | | |
|---|---|---|---|---|
| GB | 2100237 A | * | 12/1982 | B65D 47/0814 |
| WO | WO-2009101195 A1 | * | 8/2009 | B65D 35/46 |

* cited by examiner

*Primary Examiner* — Donnell A Long
(74) *Attorney, Agent, or Firm* — David T. Stephenson; Vincent G. LoTempio

(57) ABSTRACT

A two-part plug assembly is disclosed for a drip-proof spout on an aseptic flexible container for flowable materials. The two-part plug assembly may include a plug and a plug insert, wherein the plug insert may include a flow inhibitor such as a baffle or valve. In a first step, the plug assembly is removably placed in a first position on a spout prior to aseptic filling. During filling, the plug assembly is removed. After filling, the plug insert assembly is replaced in a second position further down the spout wherein the plug insert fixedly engages the spout. When fixedly engaged to the spout, the plug insert remains inside the spout when the plug is removed prior to a user dispensing the flowable material. When a cap is included, the plug assembly may shift position to allow a cap shaft to engage the flow inhibitor when the plug is removed.

23 Claims, 36 Drawing Sheets

CAP AND TWO-PART PLUG ASSEMBLY FOR A DRIP-PROOF SPOUT

CROSS-REFERENCE TO RELATED APPLICATIONS

This patent application claims the benefit of U.S. Prov. Pat. App. Ser. No. 63/410,863 filed Sep. 28, 2022, which is incorporated herein in its entirety.

TECHNICAL FIELD

This disclosure relates to a dispensing apparatus for a container.

BACKGROUND

Aseptic pouch technology disclosing a removable plug for aseptic filling is known in the art. U.S. Pat. Nos. 9,751,677, 10,035,614, and 10,370,165, each of which is hereby incorporated by reference in its entirety, are generally directed to aseptic plug technology, wherein a plug is placed on a pouch and sterilized prior to aseptic filling in an aseptic filling machine. In the method described in the '677, '614 and '165 patents, a plug is removed in an aseptic environment prior to filling and replaced in the aseptic environment after filling. A cap is then placed on the plug. U.S. Pat. Nos. 10,829,286 and 11,167,903, each of which is hereby incorporated by reference in its entirety, disclose a cap structure and a method of capping. U.S. Pat. No. 9,751,677 is directed to a plug and U.S. Pat. No. 10,035,614 is directed to a method for filling an aseptic pouch. The '677 and '614 patents are hereby incorporated by reference in their entirety. U.S. Pat. No. 10,370,165 is directed to a closure structure that includes a plug and a cap and is hereby incorporated by reference in its entirety.

For certain applications, there is a need to prevent leaking from a pouch when the pouch is inverted and the cap and plug are removed. Leaking can be prevented by incorporating a flow inhibitor such as a valve or baffle in the spout or fitment. Incorporating the flow inhibitor into the spout, however, can create challenges during filling, including the need to fill through the flow inhibitor.

SUMMARY

The present disclosure solves these challenges by introducing a two-part plug assembly that includes a flow inhibitor for a drip-proof spout, particularly for low acid aseptic containers, that can be removed in the aseptic zone prior to filling. The two-part plug may be used in conjunction with filling a flexible container such as an aseptic pouch. Steps in the filling process may include providing a pouch having a fitment with a spout, wherein a two-part plug assembly may be sealingly engaged to the spout. Prior to filling the pouch, the plug assembly may be placed in a pre-filling position, partially depressed along the spout, thereby precluding access into the pouch, but the plug assembly is not yet in a fixed, or locked, engagement with the spout. For filling, the plug assembly is removed, and the pouch may be filled with a filling tube in an aseptic filling machine. After filling, the plug assembly is replaced, however, the plug assembly fixedly engages the spout at a location more proximal to the flexible container.

The two-part plug assembly fixedly engages the spout with only one of its two parts. The two parts of the plug assembly are a plug and a plug insert. The plug may comprise the outer and upper portions of the plug assembly while the plug insert may be situated inside the plug. The plug insert may include tabs and a recesses for fixedly engaging with the spout, and may also include a flow inhibitor such as a valve or baffle. The flow inhibitor may be designed to prevent leakage of a liquid or semi-liquid product contained in the flexible container prior to consumer use.

To dispense product, the plug may be first removed and, due to the fixed engagement of the plug insert with the spout, the plug insert and flow inhibitor may remain in the spout. Retention of the plug insert and associated flow inhibitor in the spout may prevent flowable material in the pouch from leaking out of the spout when the container is inverted. In the present disclosure, the product may only be dispensed when the pouch is squeezed with sufficient force.

In one embodiment, designed for the present disclosure to incorporate a hinged, stand on style cap that can be inverted into a cap down position, a cap is coupled to the fitment and comprises a lid, a cap base, and a support surface to support a container in an inverted cap-down orientation. The cap may enclose the plug assembly when the lid is in a closed position. The lid may comprise a cap shaft on the inner side of the lid configured to insert into a plug recess on an upper side of the plug when the lid is in the closed position. The plug may have a plug shaft, wherein a plug recess may be located within the plug shaft and the cap shaft may be configured to be inserted into the plug recess.

In some embodiments, the plug shaft may have a plug shaft end configured to engage with the means for inhibiting the flow of the flowable material through the spout. The plug insert recess may be widened to include a buffer zone and has a height greater than a height of the plug insert tab such that the plug insert tab can move from a proximal first position to a distal second position when the plug is removed and a force is applied on the plug insert in a distal direction. In this position, the cap shaft may be configured to engage the means for inhibiting the flow of the flowable material through the spout when the plug insert is in the second distal position and the hinged cap is in the closed position.

DETAILED DESCRIPTION

Unless otherwise defined, all technical and scientific terms used herein have the same meaning as commonly understood by one of ordinary skill in the art to which this invention pertains. Although methods and materials similar or equivalent to those described herein can be used to practice the invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting. In addition, it will be understood that the drawings are merely schematic representations of the invention, and some of the components may have been distorted from actual scale for purposes of pictorial clarity.

The details of one or more embodiments of the invention are set forth in the accompanying drawings and the description below. Other features, objects, and advantages of the invention will be apparent from the description and drawings, and from the claims. All fittings, including friction fittings, may be calibrated through optimization to produce the intended results contemplated within the scope of the present disclosure.

Figure 1:
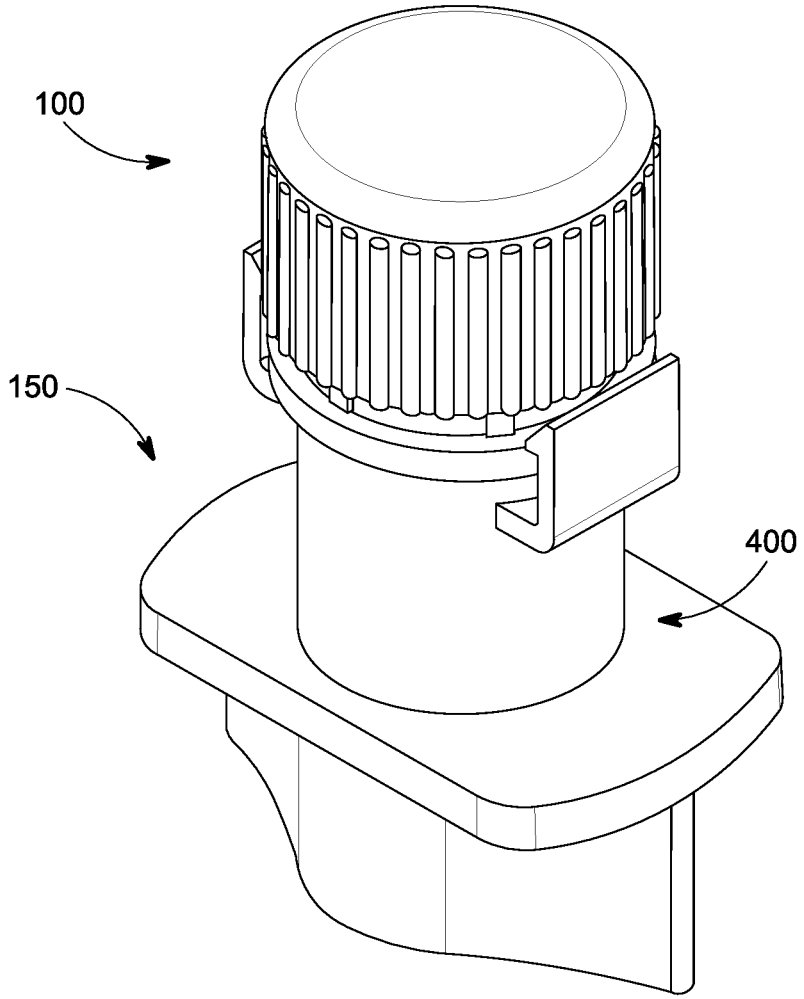
FIG. 1 is a top perspective view of a plug affixed to a spout on a fitment, in accordance with the present disclosure.
Figure 3:
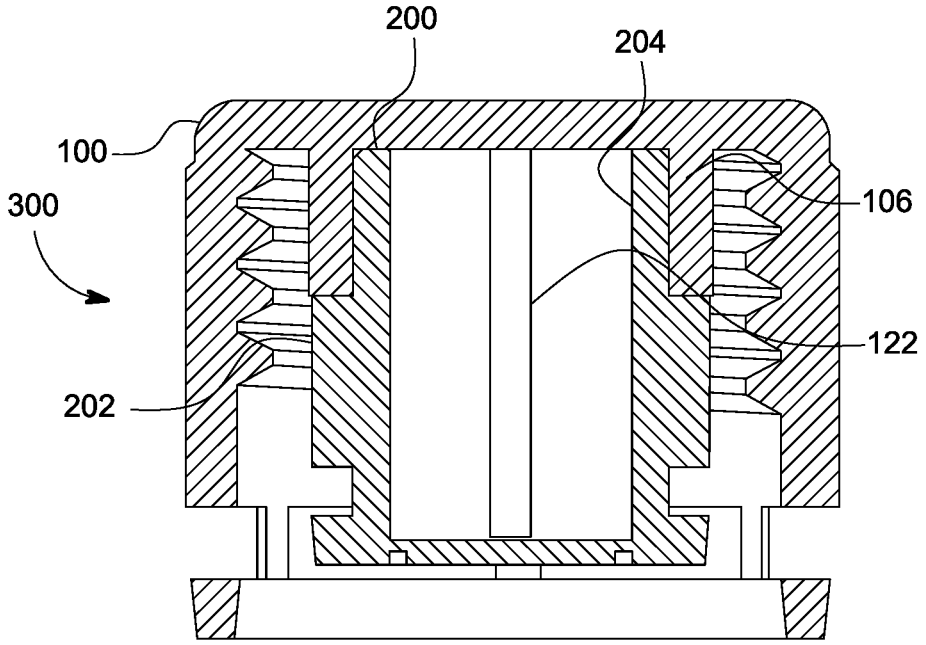
FIG. 3 is a cross sectional view of a plug assembly, in accordance with the present disclosure.

Referring now to the drawings, FIGS. 1 and 3 show plug 100 and plug assembly 300. Plug assembly 300 may be configured for use in an aseptic pouch filler. Aseptic filling assemblies are configured to fill pouches in an aseptic environment and within an aseptic zone. An aseptic zone comprises a zone that is under a positive flow of sterilized gas. Aseptic standards may be followed, such as those disclosed in Title 21 of the Code of Federal Regulations pertaining to thermally processed low acid foods packaged in hermetically sealed containers overseen by the U.S. FDA, 3-A Sanitary Standards, Inc. and European Hygienic Engineering and Design Group (EHEDG) Standards.

Prior to filling, a flexible container 1100 (shown in FIG. 36) may be pre-sterilized prior to introduction into filler equipment through, for example, gamma, x-ray, e-beam or other sterilization process, such that the internal cavity of flexible container 1100 is free of pathogens and a sterile environment. The plug may be hermetically sealed, thereby maintaining an aseptic environment throughout the flexible container 1100 and within spout 400. Flexible containers 1100 may, in some embodiments, be comprised of multilayer polymeric structures that may include metal or metallized layers, and which may be co-extruded and laminated.

FIG. 1 shows plug 100 affixed to spout 400 of fitment 150. Fitment 150 may be in fluid communication with a container, which may be a flexible container 1100 such as a pouch, for a flowable material 600 (shown in FIG. 25). Flowable material 600 may be a liquid or a semi-solid substance. When force is applied to flexible container 1100, flowable material 600 may be dispensed from spout 400.

Figure 2B:
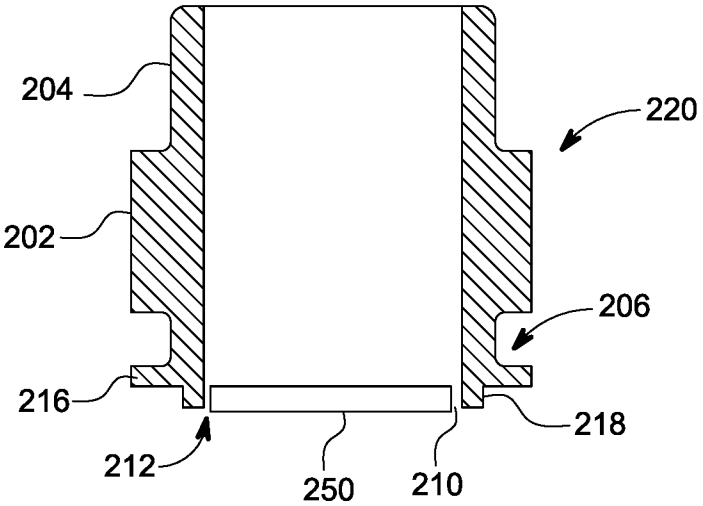
FIG. 2B is a cross sectional view of a plug insert in accordance with the present disclosure.
Figure 2A:
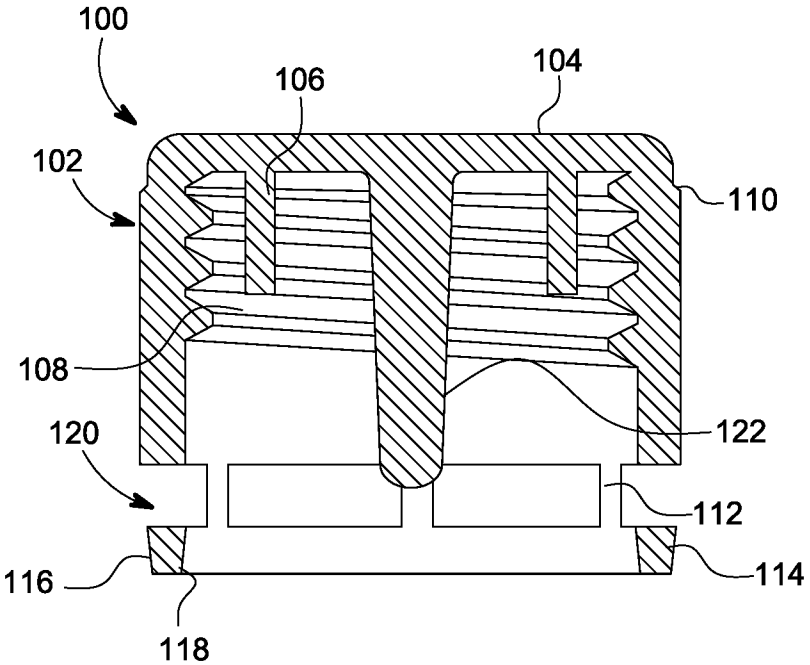
FIG. 2A is a cross sectional view of a plug, in accordance with the present disclosure.

FIGS. 2A and 2B show cross sectional views of two molded parts, plug 100 and plug insert 200. Components of the present disclosure may be comprised of plastic, elastomeric, or other material as would be known to be suitable to one of ordinary skill in the art. Components of the present disclosure may be molded, machined or otherwise produced as would be known to one of ordinary skill in the art. Plug 100 and plug insert 200 may be, in some embodiments, generally cylindrical with annular cavities and have a central axis.

With regard to FIG. 2A, in one embodiment, the structure of plug 100 may include an outer plug wall 102 having an inner surface, an outer surface, an upper end and a lower end, the inner surface defining a cavity. Outer plug wall 102 may, in one embodiment, have plug thread 108 on its inner surface and knurled portion 110 on a portion of its outer surface for facilitating unscrewing of plug 100 and providing a grippable surface. The grippable surface may be an uneven surface, or rough surface, or other type of surface that facilitates gripping as would be known to one of ordinary skill in the art. Materials for the gripping surface may be rubber, plastic, silicon and the like. Plug thread 108 may be continuous or substantially continuous, and various types of threads may be used as would be known to one of ordinary skill in the art of threaded closures. Plug 100 may also include top plug wall 104 from which inner plug wall 106 extends longitudinally in a direction proximal to the flexible container 1100. Inner plug wall 106 may have an inner surface, an outer surface, an upper end and a lower end, the inner surface defining an inner cavity. Outer plug wall 102 may, in one embodiment, be connected to tamper evident break away band 114 by a series of thin strips 112. Tamper evident break away band 114 may include an inner chamfer 118 and an outer chamfer 116 on its inner and outer surfaces, respectively, to assist with connecting outer plug wall 102 to spout 400. Spout 400, and fitment 150, may be molded from a polymer such as a polyethylene, or other plastic, and the like. The particular material from which the spout is formed is disclosed for exemplary purposes only and is not deemed as being limiting. In some embodiments, plug shaft 122 may depend downwardly from top plug wall 104 for the purpose of engaging flow inhibitor 250 (shown in FIG. 2B) to prevent leakage of flowable material 600 when plug insert 200 is inserted into plug 100 (as shown in FIG. 3).

FIG. 2B shows plug insert 200, which may be inserted into plug 100. Plug insert 200 may include central plug insert portion 202, distal plug insert portion 204, and proximal plug insert portion 218. Proximal plug insert portion 218 is the closest portion of plug insert 200 to flexible container 1100 when plug assembly 300 is placed on spout 400. Proximal plug insert portion 218 may include plug insert recess 206, plug insert tab 216 and flow inhibitor 250. Plug insert recess 206 may, in some embodiments, be discontinuous around a circumference of plug insert 200, and may, in some embodiments, be continuous.

Plug insert body 220 may include all elements of plug insert 200 except flow inhibitor 250. In some embodiments, flow inhibitor 250 may be a hinged or hingeable baffle or a valve. Flow inhibitor 250 may be comprised of plastic, elastomeric, metal, composite or other material as would be known to be suitable to one of ordinary skill in the art. In some embodiments where flow inhibitor 250 is a baffle, for example as may be shown in FIG. 9, then a more rigid material may be preferable. If flow inhibitor 250 is a valve, as may be shown in one embodiment of FIGS. 10 and 11, then a more flexible material may be preferable.

In some embodiments, flow inhibitor 250 may be connected to proximal plug insert portion 218 by a hinge 210 with a narrow gap situated between flow inhibitor 250 and proximal plug insert portion 218. Hinge 210 may be a living hinge, such as a straight or flat living hinge, a butterfly living hinge, a double or triple living hinge and the like, as would be known to one of ordinary skill in the art. The living hinge may be produced by subtractive manufacturing, injection molding, 3d printing, rubber molding and the like, as would be known to one of ordinary skill in the art. Other types of suitable hinges may be employed as would be known to one of ordinary skill in the art.

In some embodiments, flow inhibitor 250 may be a valve comprised of flexible plastic, silicon, silicon rubber, or silicon type material, and may be a star valve, or Aptar® SimpliSqueeze® type self-sealing valve as may be used with condiment bottles, household cleaning bottles and the like, as would be known to one of ordinary skill in the art. Embodiments of such valves are shown in FIGS. 13 and 14 of U.S. Pat. No. 5,213,236 and described throughout the patent, which is hereby incorporated by reference in its entirety.

FIG. 3 shows a cross sectional view of plug 100 and plug insert 200 assembled together to form plug assembly 300. The outer diameter of distal plug insert portion 204, which may have a smaller diameter relative to the central plug insert portion 202, and the inner diameter of inner plug wall 106 may be sized in such a manner that the two parts may slide together and apart with exertion of minimal force, forming a dimensional fit known in the art as a friction fit. A friction fit may, in some embodiments, be sufficient to maintain an aseptic or sterile environment in flexible container 1100.

In some embodiments, plug 100 may be threaded or unthreaded. In some embodiments, plug 100 and plug assembly 300 may connect to spout 400 by a threading mechanism or by a friction fit. Plug 100 may be comprised of flexible, elastomeric, rigid or semi-rigid material. In some embodiments plug 100 may have a dual function as a cap and a plug. In some embodiments, plug 100 may have an outer surface adapted for gripping by a human hand.

Figure 4:
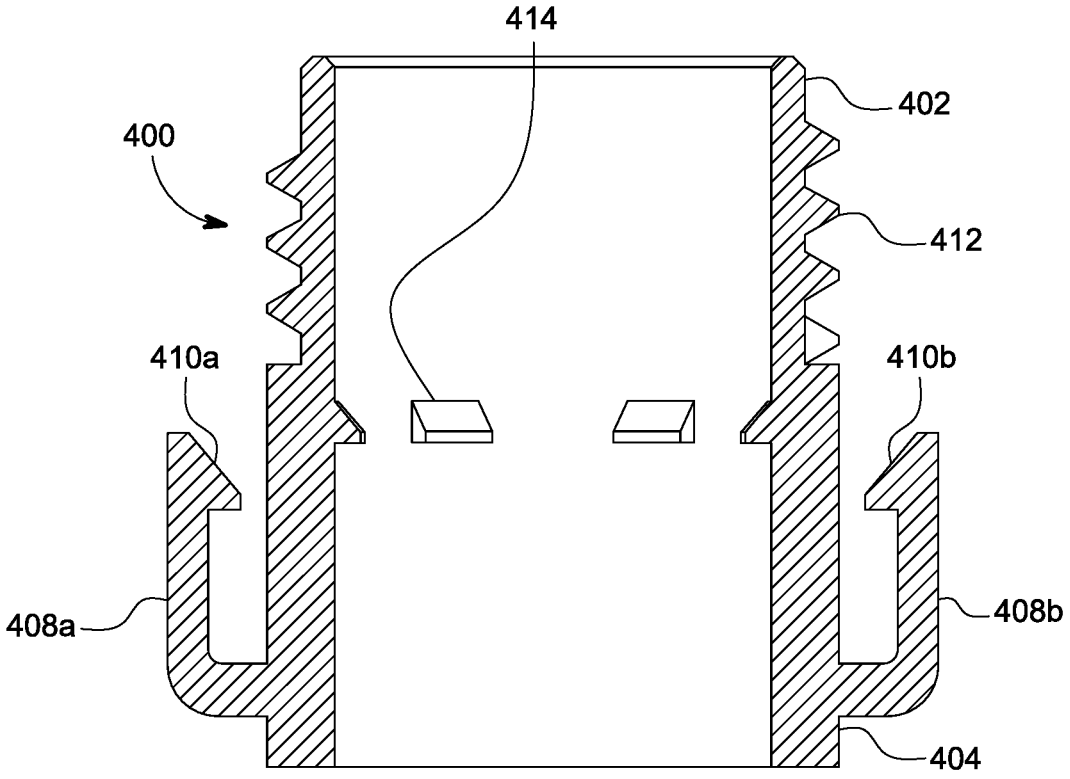
FIG. 4 is a cross sectional view of a spout, in accordance with the present disclosure.
Figure 6:
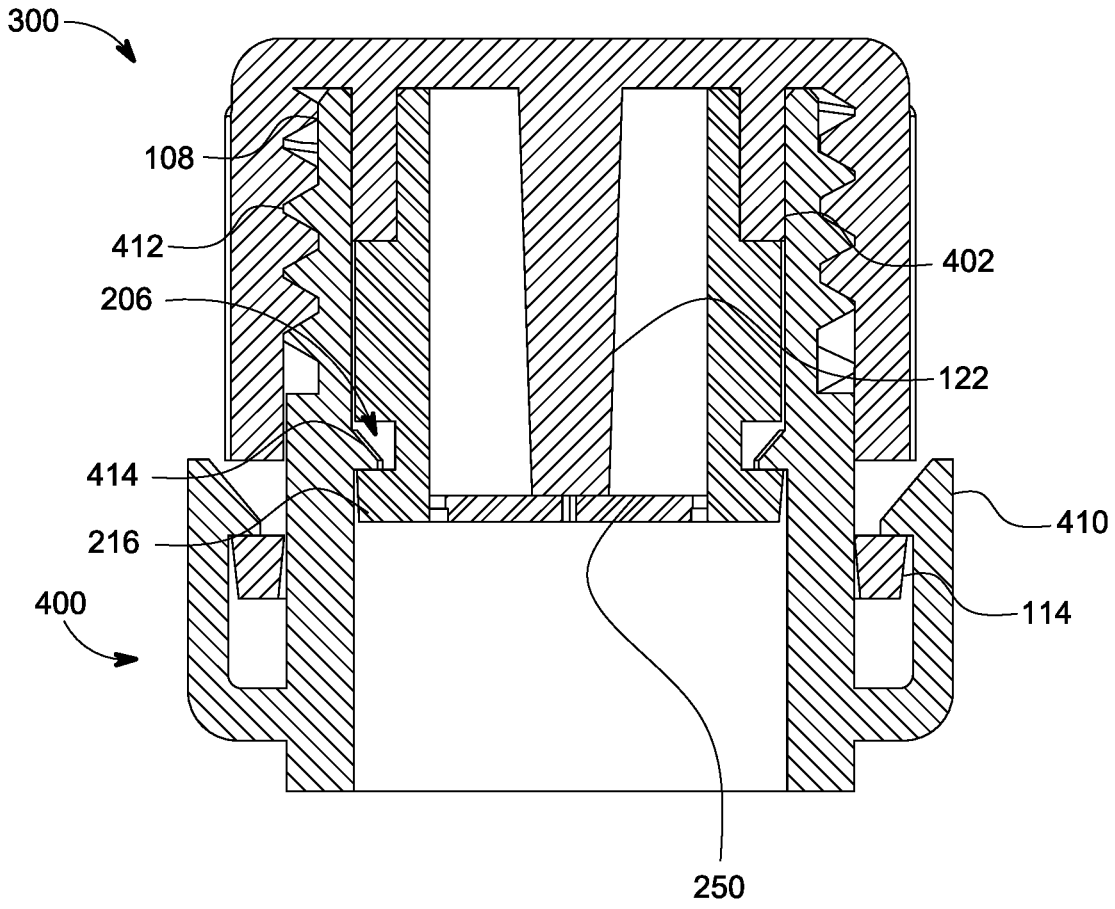
FIG. 6 is a cross sectional view of a plug assembly in a post-filling position on a spout, in accordance with the present disclosure.

FIG. 4 shows a cross sectional view of spout 400, including spout neck 402, spout thread 412, and spout body 404 with its lower end (not shown) designed to be in fluid communication preferably with a pouch or other flexible container 1100 for flowable material 600. Flexible container 1100 may be filled by automatic filling equipment and dispensed by an end user such as a consumer. Spout body 404 may, in some embodiments, include a plurality of extension arms 408*a* and 408*b* and a plurality of arm tabs 410*a* and 410*b* designed to act as tamper evident features, as will be described in further detail below. At least one internal spout tab 414 may secure plug insert 200 to spout 400 after filling of flexible container 1100, as shown in FIG. 6. In some embodiments, internal spout tabs 414 may be placed approximately at, adjacent to, or distal to a mold parting line.

Figure 5:
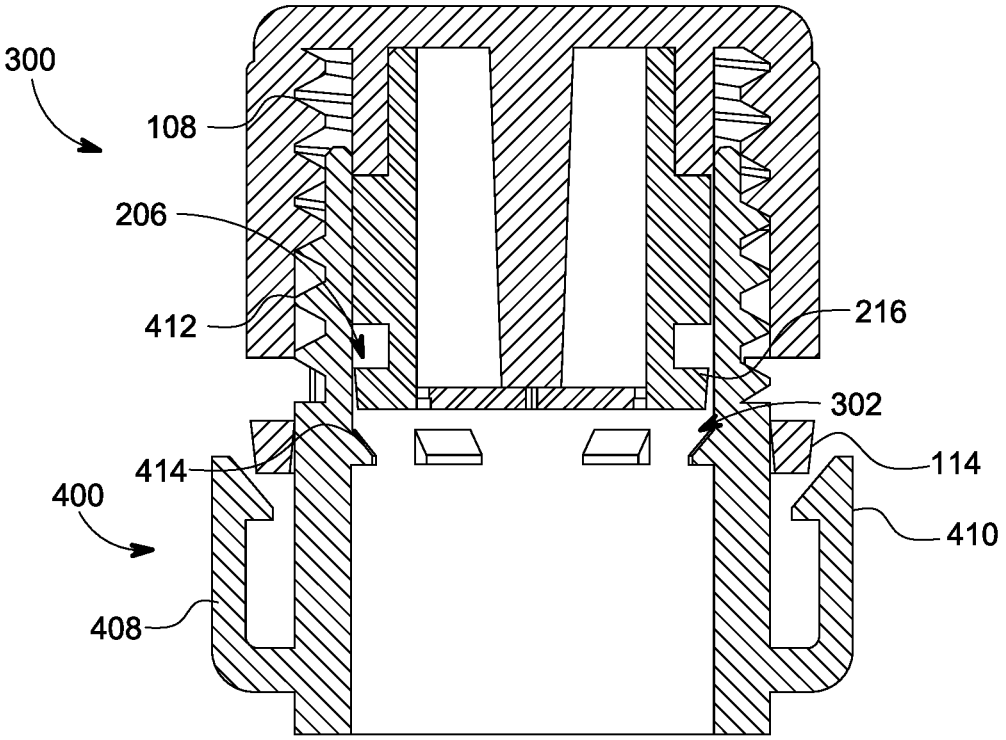
FIG. 5 is a cross sectional view of a plug assembly in a pre-filling position on a spout, in accordance with the present disclosure.

FIG. 5 is a cross sectional view of plug assembly 300 positioned on spout 400 after, in some embodiments, spout 400 and flexible container 1100 have been sterilized. During pre-filling placement of plug assembly 300 on spout 400, plug thread 108 is not fully engaged with spout thread 412, as evidenced by the presence of gap 302 between internal spout tabs 414 and plug insert 200. Plug insert tabs 216 are, in the pre-filling position of plug assembly 300, located distal to internal spout tabs 414. This limited engagement, during the pre-filling placement of plug assembly 300 on spout 400, ensures that tamper evident break away band 114 is not secured by arm tabs 410 and that internal spout tabs 414 do not secure plug insert 200 in spout 400 by entering plug insert recess 206 and fixedly engaging plug insert tabs 216. Plug insert tabs 216 may generally be defined as a feature adjacent and below, or proximal to, plug insert recess 206 adapted to fixedly engage internal spout tabs 414 to keep plug insert 200 in its appropriate place for the purpose of the present disclosure. and may not be limited by any particular structure. Contact between plug assembly 300 and spout 400 may be sufficient to form a seal that maintains the sterility of plug assembly 300 in order to avoid any contamination prior to filling flexible container 1100. In some embodiments of the present disclosure, this seal meets aseptic processing standards as established by the Food and Drug Administration (FDA) at the time of filing of the present disclosure.

FIG. 6 is a cross sectional view of plug assembly 300 inserted into spout 400 after flexible container 1100 has been filled. Prior to filling, plug assembly 300 may be located in a sterile atmosphere and the plug assembly 300 may be removed for filling. Flowable material 600 (shown in FIG. 25) may then be injected through spout neck 402 and into flexible container 1100. Plug assembly 300 may then be replaced and fully engaged with spout thread 412 upon post-filling placement of plug assembly 300. Full engagement may include plug insert tabs 216 fixedly engaging internal spout tabs 414, wherein internal spout tabs 414 are positioned within plug insert recess 206. In some embodiments, full engagement between plug assembly 300 and spout 400 may ensure that tamper evident break away band 114 may be secured by the arm tabs 410 and that internal spout tabs 414 may be secured in plug insert recess 206 by fixed engagement with plug insert tabs 216. The depth of internal spout tabs 414 may be minimal such that they do not project too far into the spout cavity and substantially interfere with placement of a filling tube 1050 through spout 400 during filling, while internal spout tabs 414 may be deep enough to fixedly engage plug insert tabs 216 in order to retain plug insert 200 in the spout prior to dispensing of flowable material 600. While an optimal depth of internal spout tabs 414 may vary, an optimal depth may be determined through routine optimization, as would be known to one of ordinary skill in the art.

The means of engagement between plug insert 200 and spout 400, shown for exemplary purposes in FIG. 6 as comprising plug insert tabs 216 and internal spout tabs 414, is not intended to be limiting. Any suitable means of fixed engagement is within the scope of the present disclosure, including connection means such as male-female (plug, pin, prong, receptacle, socket, slot), genderless, mechanical, magnetic, friction fit, modular and other attachment or connection means as would be known to one of ordinary skill in the art. FIG. 6 illustrates the configuration of plug assembly 300 and spout 400, generally, when the apparatus is ready for consumer use.

Figure 7B:
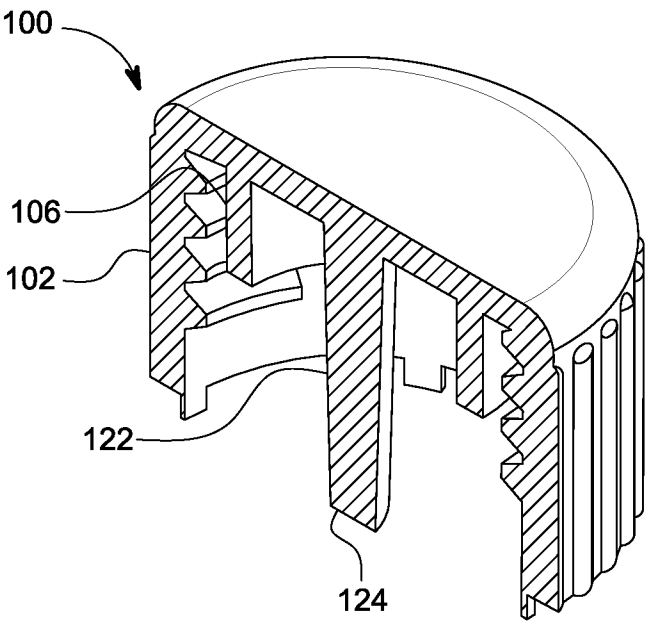
FIG. 7B is a cross sectional perspective view of a plug removed from a spout, in accordance with the present disclosure.
Figure 7A:
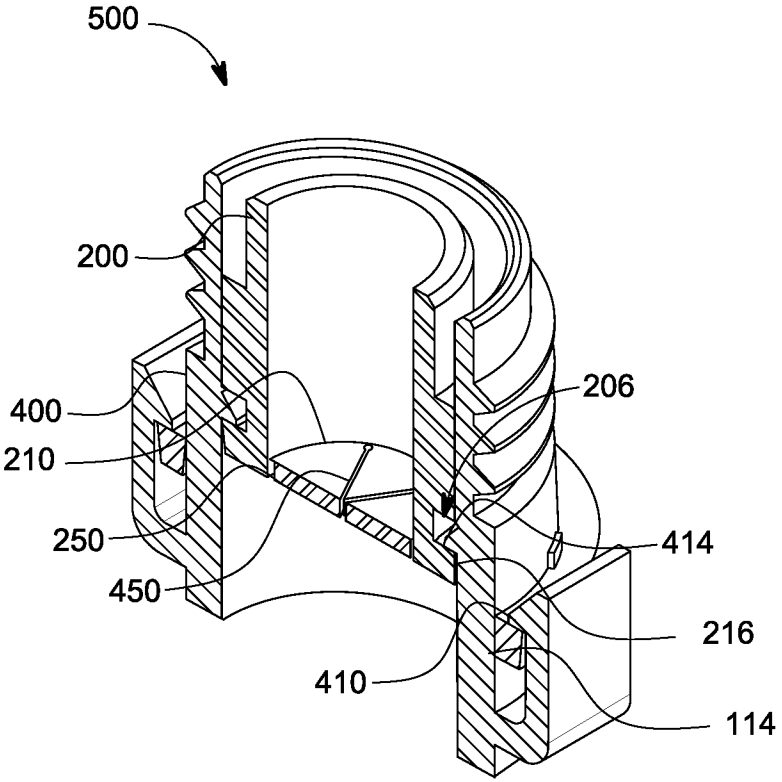
FIG. 7A is a cross sectional perspective view of a plug insert assembly in accordance with the present disclosure.

As shown in FIGS. 6, 7A and 7B, in some embodiments, plug shaft 122 may be adapted to engage with flow inhibitor 250. Plug shaft 122 may serve to prevent unintended opening of flow inhibitor 250 during shipping, handling, or transport. Plug shaft 122 may be integral with top plug wall 104 and may be engaged with flow inhibitor 250 in plug assembly 300 to prevent unintended flow through flow inhibitor 250. Plug shaft 122 may forcibly prevent unintended opening of flow inhibitor 250 due to its close proximity to flow inhibitor 250. Once plug 100 is separated from plug insert 200 by an end user, plug shaft 122 may be removed from its position in plug assembly 300 and force applied to flexible container 1100 by a user may then allow flowable material 600 to be dispensed through flow inhibitor 250.

FIG. 7A is a cross sectional view of plug insert assembly 500, which includes spout 400 after removal of plug 100, leaving plug insert 200 secured in place by internal spout tabs 414 fixedly engaged with plug insert tabs 216. Also shown in FIG. 7A is tamper evident break away band 114 held in place by arm tabs 410. With regard to tamper evidence, in some embodiments, when a user rotates plug 100, thin strips 112 will snap, providing evidence that plug 100 has not been previously removed. FIG. 7B shows plug 100 after tamper evident break away band 114 has been detached and plug 100 has been removed from spout 400, thereby allowing dispensing of flowable material 600.

Figure 9:
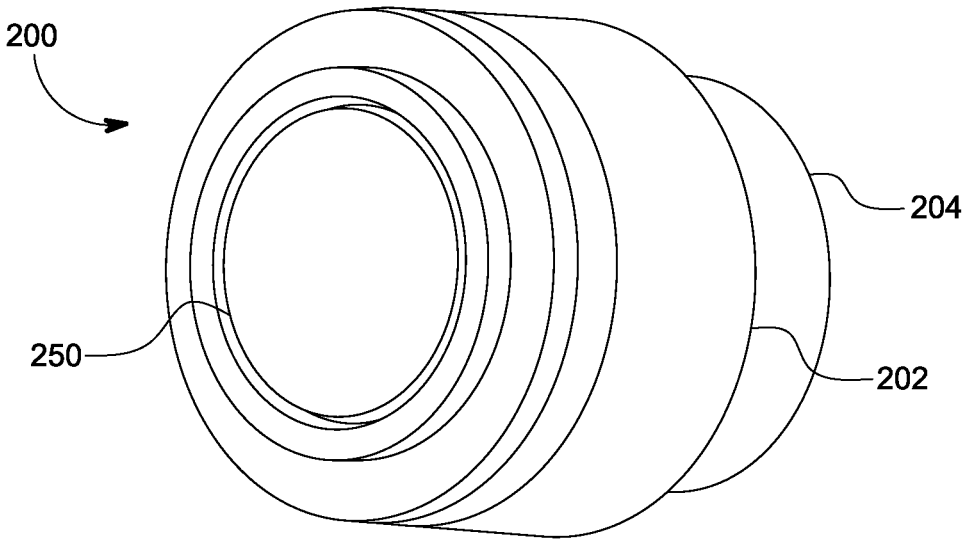
FIG. 9 is a top perspective view of one embodiment of an aseptic plug insert including a flow inhibitor, in accordance with the present disclosure.

Once flexible container 1100 has been filled and plug assembly 300 has been replaced into a post-filling position, flexible container 1100 may be stored or positioned with spout 400 facing down and flow inhibitor 250 may prevent leakage of flowable material 600. In some embodiments, leakage may be prevented by capillary forces generated by narrow gaps between flow inhibitor 250, which may be a baffle as shown in FIG. 9, and the cylindrical inner surface of plug insert 200. In some embodiments, hinge 210 (shown in FIG. 2B) may flex to allow flowable material 600 to be dispensed from plug insert 200 when a predetermined internal pressure is applied to the flexible container 1100. In some embodiments, flow inhibitor 250 may have wedge shaped sections 450 (shown in FIG. 7A), that may be rigid or flexible in some embodiments, that open upon pressure applied to flexible container 1100. Other shapes and designs for flow inhibitor 250 are contemplated within the scope of the present disclosure, including a solid circular shape for a baffle.

Figure 8:
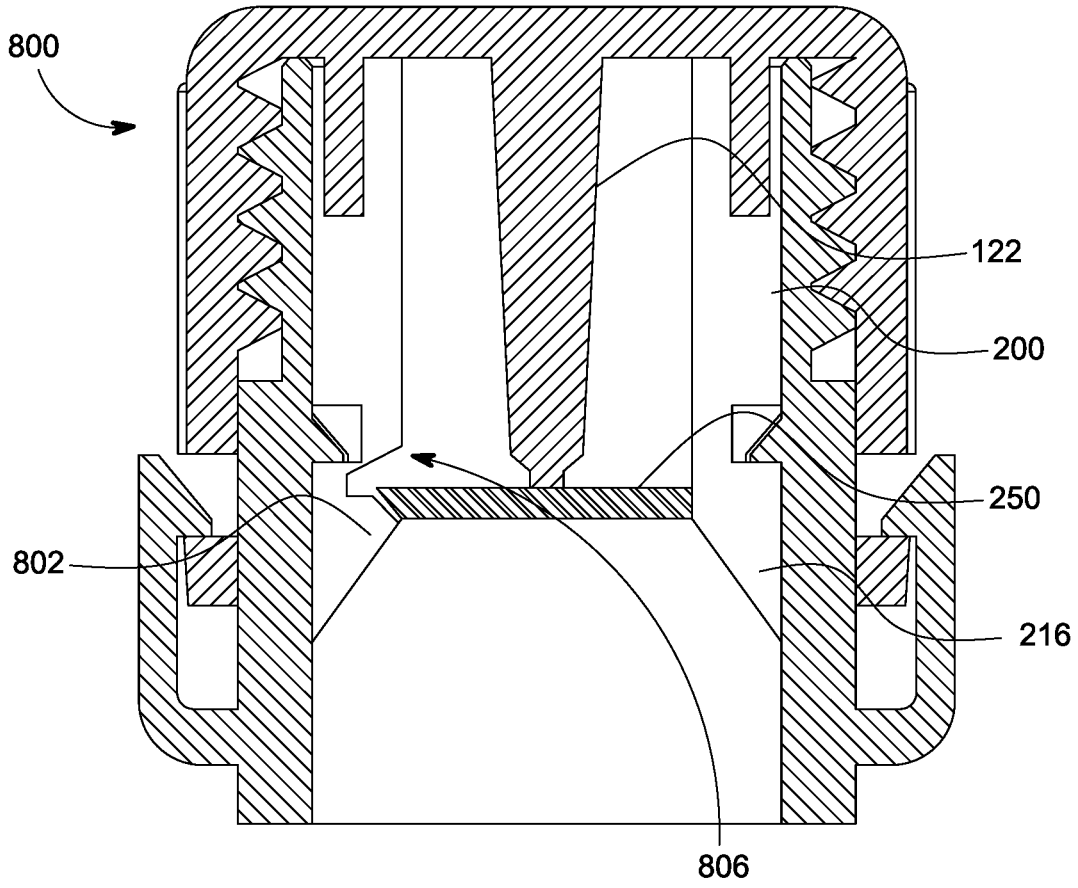
FIG. 8 is a cross sectional view of a plug assembly fixedly engaged with a spout, wherein a plug insert includes a compression recess, in accordance with the present disclosure.

FIG. 8 shows one embodiment of the present disclosure that includes features for prevention of deformation of plug insert 200. In some embodiments, it may be desirable to prevent deformation of plug insert 200 during insertion to maintain proper positioning of flow inhibitor 250. Insertion of plug insert 200 into its final position may cause radial force on plug insert 200 as plug insert tab 216 moves past internal spout tabs 414 to snap into post-filling position. Compression support lip 802 may have an angled surface that aligns underneath an angled edge on flow inhibitor 250 above compression support lip 802. This configuration provides upward force on flow inhibitor 250 into plug shaft 122 upon application of radial force to plug insert 200 during insertion of plug assembly 300 in spout 400. With application of radial force, plug shaft 122 may thereby prevent flow inhibitor 250 from being dislocated and potentially allowing leakage of flowable material 600 or malfunction of flow inhibitor 250. Compression recess 806 may reduce pressure applied to flow inhibitor 250 by plug shaft 122 by permitting sliding of the edge of flow inhibitor 250 up and into an inner surface of plug insert 200 during insertion into spout 400, as flow inhibitor 250 may flex slightly around plug shaft 122 during compression of plug insert 200. The edge of flow inhibitor 250 may be angled, in some embodiments to slidingly engage compression recess 806. In some embodiments, plug insert tab 216 may extend further into spout 400 at an angle, in the direction opposite of compression support lip 802, such that a substantially straight line may be formed from compression support lip 802 of plug insert tab 216 to the inner surface of spout body 404.

Alternative approaches to prevent compression of the plug insert 200 and dislocation of flow inhibitor 250 may include positioning flow inhibitor 250 at a distance far enough from the plug insert recess 206 to avoid deformation of flow inhibitor 250 during insertion of plug assembly 300 into spout 400. Alternatively, adding flexibility to internal spout tabs 414 or plug insert tabs 216 by shaping them as a fishhook may reduce deformation or dislocation of flow inhibitor 250. Use of less rigid material for plug 100 and spout 400 may, in some embodiments, also be used to reduce deformation or dislocation of flow inhibitor 250, where, when more rigid material is used for plug insert 200 when compared to spout 400 material, deformation or dislocation of plug insert 200 may be limited or reduced.

FIG. 9 is a top perspective view of an aseptic plug insert 200 including flow inhibitor 250, where flow inhibitor 250 may be hinged or hingeable (as shown in FIG. 2B). Flow inhibitor 250, in FIG. 9, is shown as having a solid, or plate, shape, and wherein, in some embodiments, plug insert body 220 may be comprised of rigid plastic, or other rigid material, and flow inhibitor 250 shown in FIG. 10 may be comprised of rigid material such as rigid plastic and may be a hinged baffle with one-way directionality. In some embodiments, flow inhibitor 250 may not be hinged. In one embodiment, FIG. 10 shows a plug insert wherein a plug insert body 220 may be comprised of a hard material such as plastic and flow inhibitor 250 may be comprised of an elastomeric or flexible material.

Figure 10:
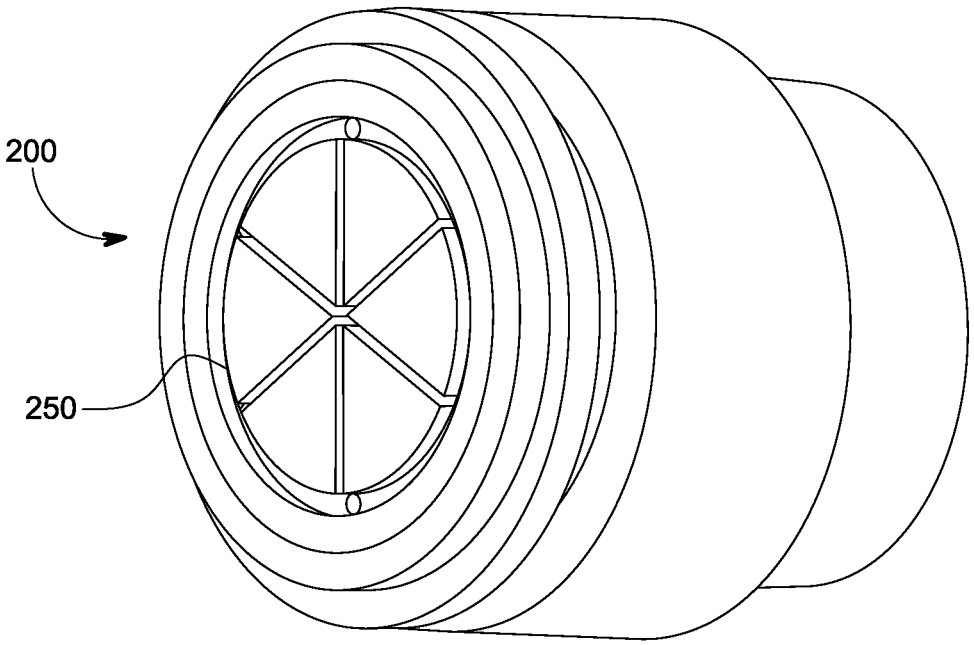
FIG. 10 is a top perspective view of one embodiment of a plug insert, in accordance with the present disclosure.

FIG. 10 is a top perspective view of aseptic plug insert 200 showing flow inhibitor 250 having a star or wedge shape, and wherein, in some embodiments, plug insert body 220 may be comprised of rigid plastic, or other rigid material, and flow inhibitor 250 may be comprised of a flexible material such as silicon, silicon rubber, rubber, or an elastomer with similar functionality to silicon or silicon-based materials. Alternatively, in some embodiments, flow inhibitor 250 shown in FIG. 10 may be comprised of rigid material such as rigid plastic and may be a hinged baffle with one-way directionality.

Figure 11:
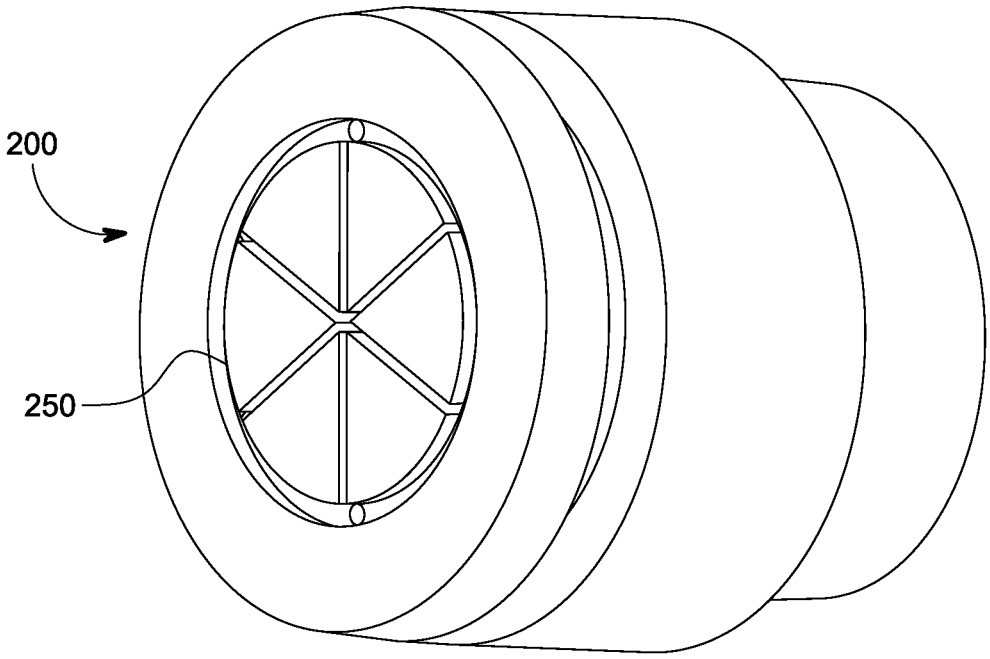
FIG. 11 is a top perspective view of one embodiment of a plug insert, in accordance with the present disclosure.

FIG. 11 is a top perspective view of aseptic plug insert 200, wherein both plug insert body 220 and flow inhibitor 250 may be molded from a flexible material such as silicon, silicon rubber, rubber, or an elastomer with similar functionality to silicon-based materials. In one embodiment, FIG. 11 shows a flexible plug insert 200, wherein plug insert body 220 and flow inhibitor 250 may be comprised of an elastomer.

Figure 12:
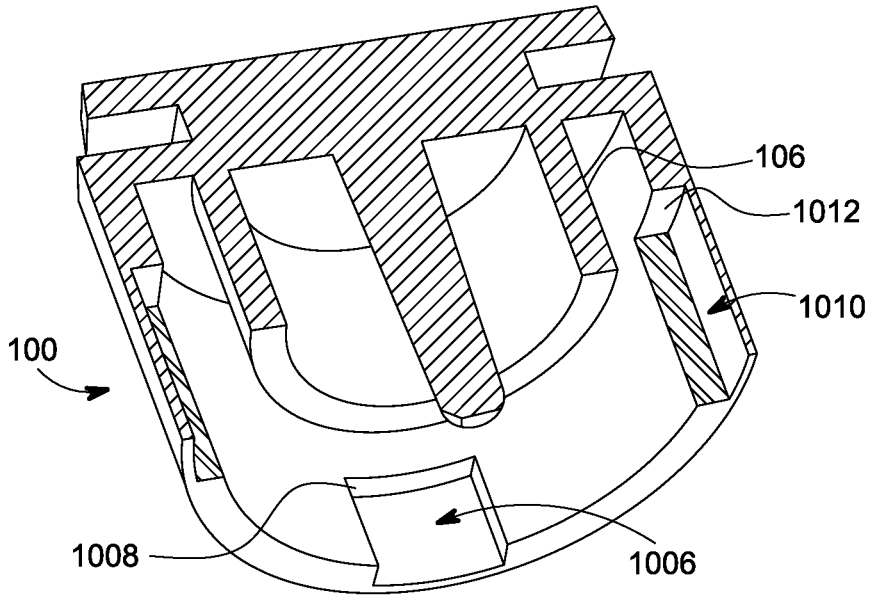
FIG. 12 is a cross sectional bottom perspective view of a plug, in accordance with the present disclosure.

FIGS. 12 and 13A-13C show plug 100 having a generally cylindrical interior and exterior, wherein inner plug wall 106 may be dimensioned for securing a friction fit with plug insert 200. Outer plug wall 102 may be dimensioned to form a seal against spout 400 and fitment 150. As shown in FIG. 12, in some embodiments, plug 100 may also include two sets of recesses, short recess 1006 which terminates at a distal end at short recess stopper 1008, and long recess 1010 which terminates at a distal end at long recess stopper 1012, as described in further detail below.

Figure 13C:
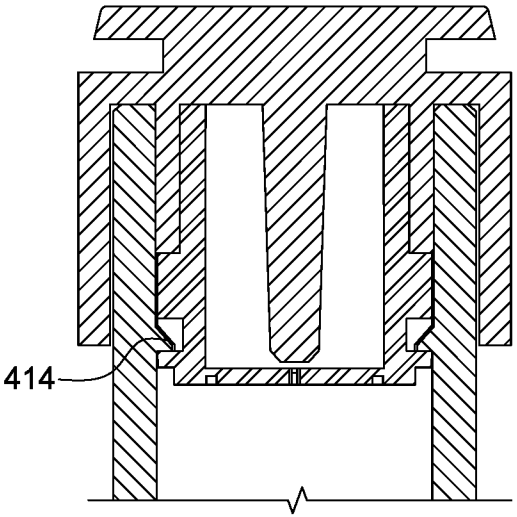
FIG. 13C is a cross sectional view of a friction fit plug assembly connected to a fitment in a post-filling position, in accordance with the present disclosure.
Figure 13B:
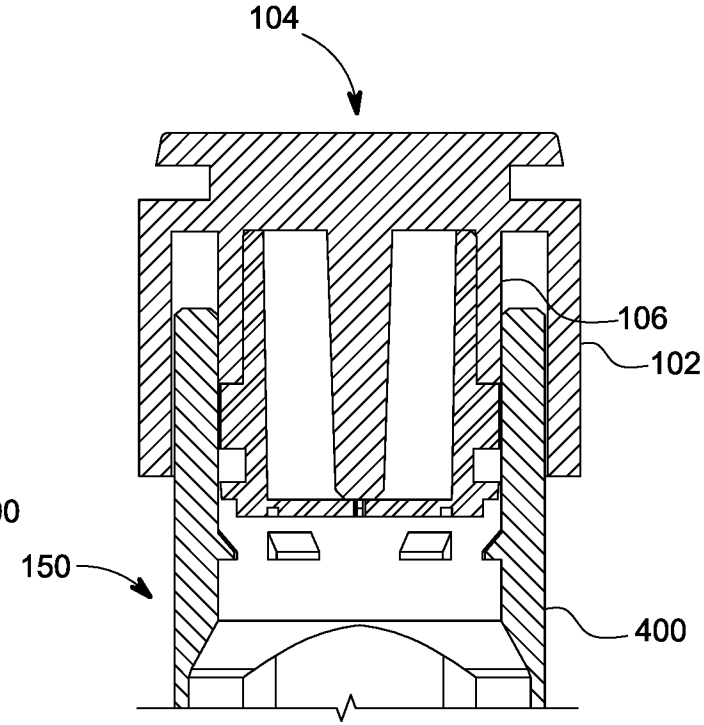
FIG. 13B is a cross sectional view of a friction fit plug assembly connected to a fitment in a pre-filling position, in accordance with the present disclosure.
Figure 13A:
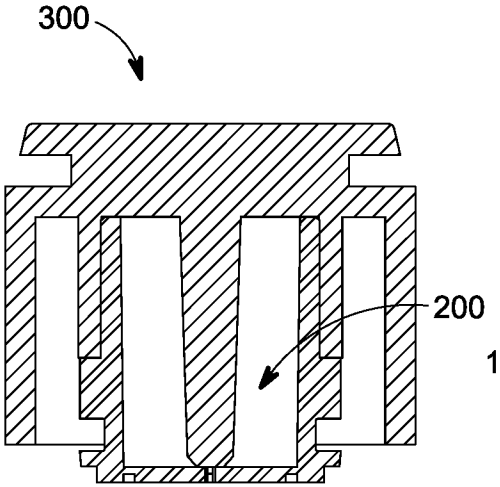
FIG. 13A is a cross sectional view of a friction fit plug assembly, in accordance with the present disclosure.
Figure 14:
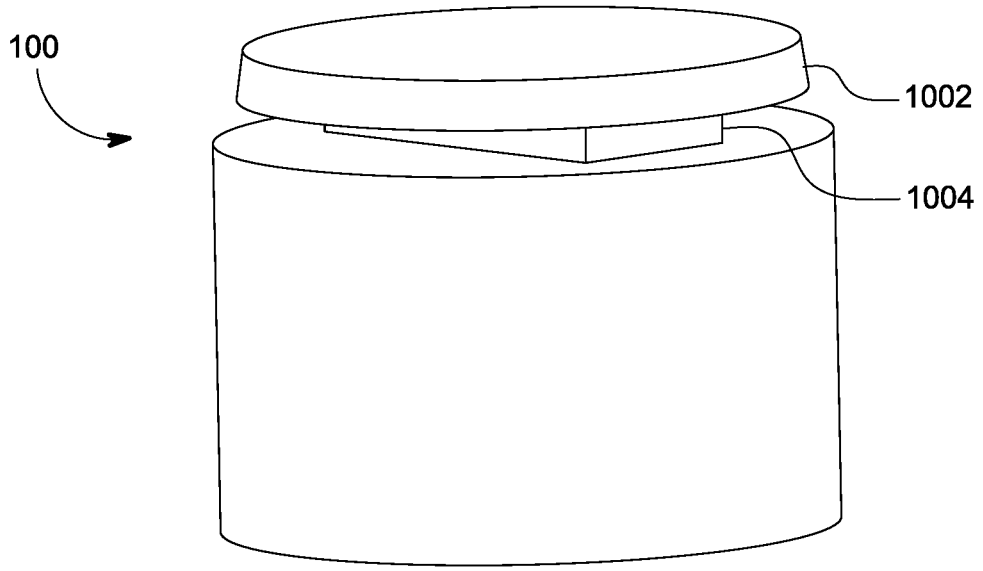
FIG. 14 is a top perspective view of a plug having a disc portion, in accordance with the present disclosure.

FIGS. 13A-C show an embodiment of plug assembly 300 affixed to spout 400 of fitment 150 through a friction fit rather than by a threaded mechanism. In one aspect, this embodiment of plug 100 of the present disclosure may be a modification of a plug shown and described in U.S. Pat. No. 9,751,677, where, in the present disclosure, the plug may be modified to include a plug insert 200. Elements of the present disclosure that may be equivalent to certain elements of the '677 patent may have the same, or different, names in the present disclosure; however, differences or similarities in names between the present disclosure and the '677 patent are not intended to be limiting or to necessarily indicate similarities or differences in structure or function.

In some embodiments of the present disclosure, plug 100 may comprise a top plug wall 104, an inner plug wall 106 and an outer plug wall 102. Outer plug wall 102 may depend from top plug wall 104 in a direction opposite top plug wall 104. Outer plug wall 102 may be axially spaced apart from inner plug wall 106. Plug 100 may be attachable to spout 400. In some embodiments, inner plug wall 106 may extend into spout 400 to provide a seal between inner plug wall 106 and spout 400 and inner plug wall 106 and distal plug insert portion 204.

FIG. 14 shows plug 100 having disc portion 1002 at the top of plug 100, for grabbing and lifting plug 100, which may be integral with the top of plug 100, where rectangular portion 1004 between disc portion 1002 and top plug wall 104 may facilitate a precise angular positioning of plug 100 in relationship to fitment 150 during the filling process. A mechanism for capping, grabbing and lifting plug 100 is described in U.S. Pat. Nos. 10,829,286 and 11,167,903, which are hereby incorporated by reference in their entirety.

Figure 15B:
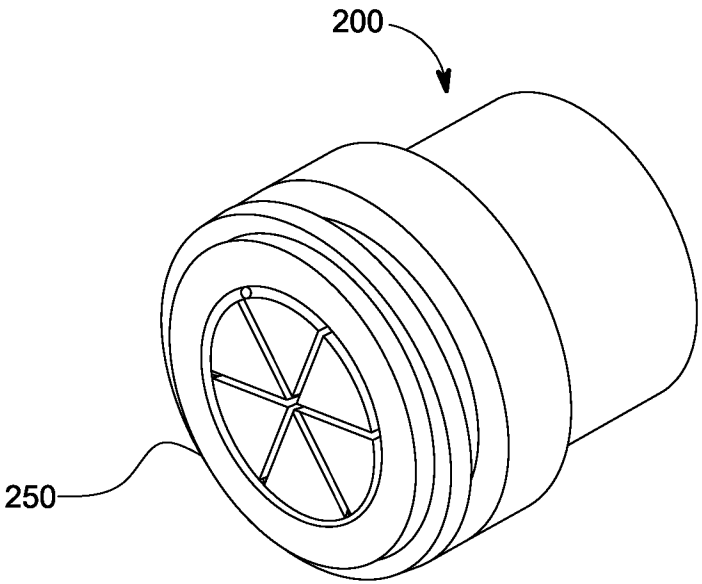
FIG. 15B is a side perspective view of plug insert with a proximal placement of a flow inhibitor, in accordance with the present disclosure.
Figure 15A:
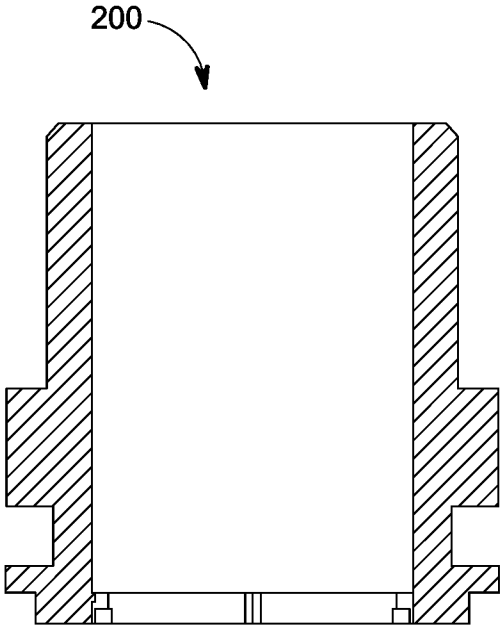
FIG. 15A is a cross sectional view of a plug insert with a proximal placement of a flow inhibitor, in accordance with the present disclosure.

FIGS. 15A and 15B show flow inhibitor 250 in a proximal-most location within plug insert 200 relative to a flexible container 1100. Flow inhibitor 250 may, in some embodiments, be positioned in any location along the axis of the plug insert 200, as may be advantageous for particular applications.

Figure 16B:
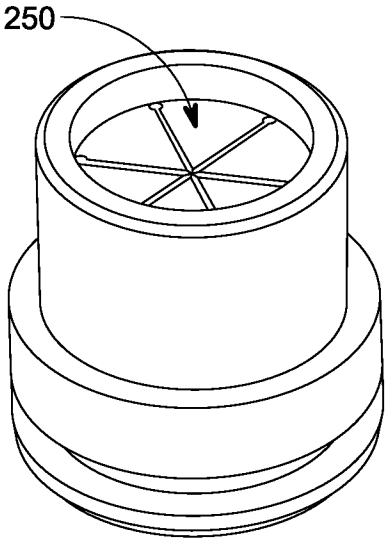
FIG. 16B is a top perspective view of plug insert with a distal placement of a flow inhibitor, in accordance with the present disclosure.
Figure 16A:
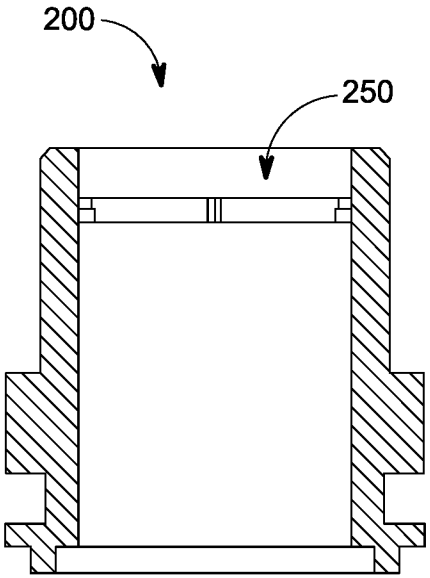
FIG. 16A is a cross sectional view of plug insert with a distal placement of a flow inhibitor, in accordance with the present disclosure.

FIGS. 16A and 16B show flow inhibitor 250 in a distal location within plug insert 200 relative to the flexible container 1100. Flow inhibitor 250 may be positioned in any location along the axis of the plug insert 200, as may be advantageous for particular applications.

Figure 17B:
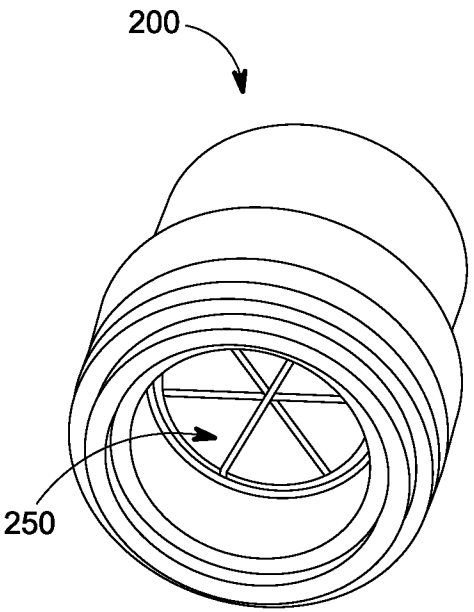
FIG. 17B is a side perspective view of plug insert with a generally central placement of a flow inhibitor, in accordance with the present disclosure.
Figure 17A:
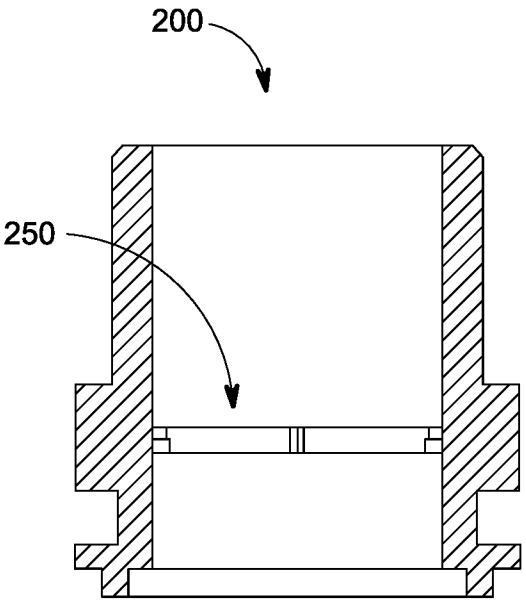
FIG. 17A is a cross sectional view of plug insert with a generally central placement of a flow inhibitor, in accordance with the present disclosure.

FIGS. 17A and 17B show flow inhibitor 250 in a central position within plug insert 200 relative to the flexible container 1100, closer to an inlet of plug insert 200 than an outlet of plug insert 200. Flow inhibitor 250 may be positioned in any location along the axis of the plug insert 200, as may be advantageous for particular applications.

Figure 18B:
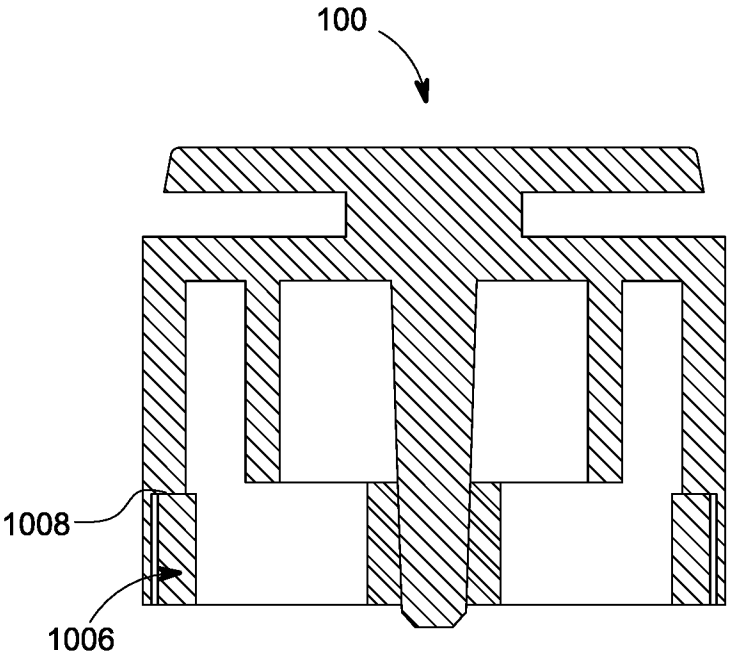
FIG. 18B is a cross sectional view of a plug illustrating short recesses, in accordance with the present disclosure.
Figure 18A:
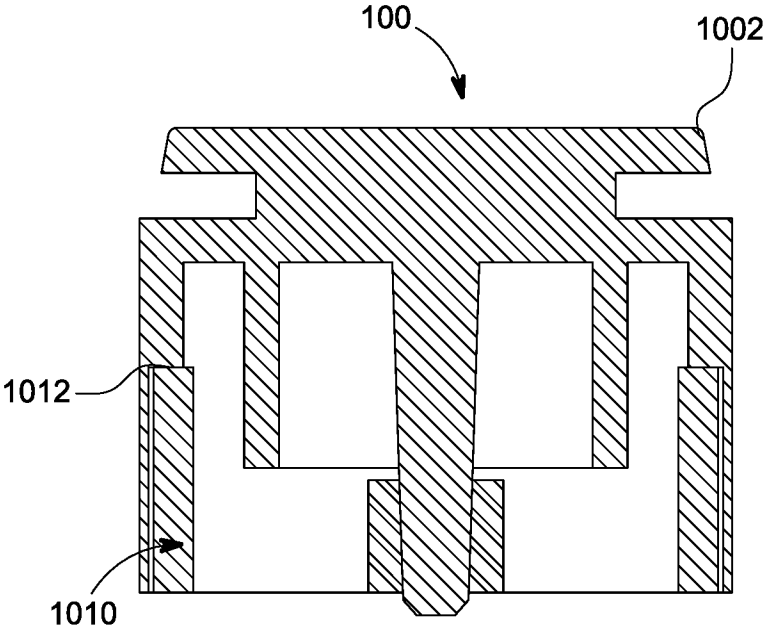
FIG. 18A is a cross sectional view of a plug illustrating long recesses, in accordance with the present disclosure.

FIGS. 18A and 18B show right angle cross-sections of plug 100 where the two sets of recesses are included in the cylindrical outer plug wall 102 of plug 100 for insertion onto spout 400 at different depths. FIG. 18A shows long recess 1010 which terminates at a distal end at long recess stopper 1012. FIG. 18B shows short recess 1006 which terminates at a distal end at short recess stopper 1008. The location of long recess 1010 and short recess 1006 is not limiting, and the location, size and dimensions of the recesses may vary within the scope of the present disclosure.

Figure 19B:
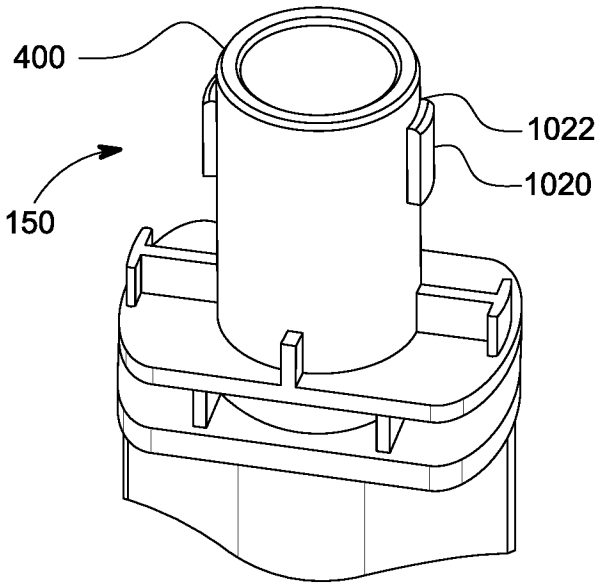
FIG. 19B is a top perspective view of a fitment with fitment bars, in accordance with the present disclosure.
Figure 19A:
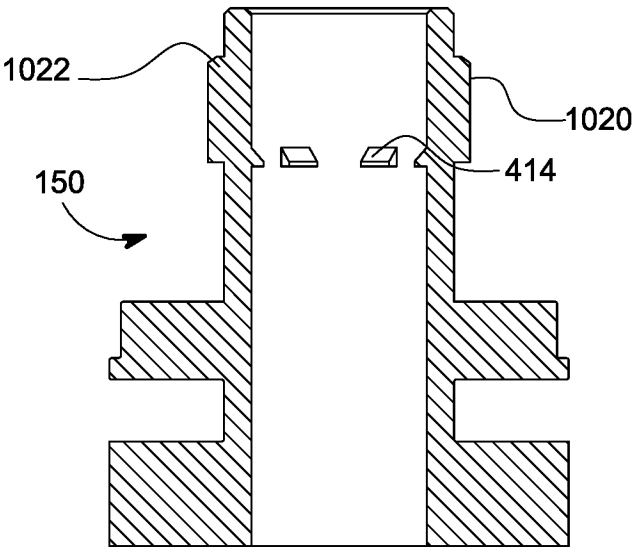
FIG. 19A is a cross sectional view of a fitment with fitment bars, in accordance with the present disclosure.

FIGS. 19A and 19B show fitment 150 with fitment bars 1020 and fitment bar stoppers 1022, where fitment bars 1020 may be located along spout 400 of fitment 150. In one embodiment of the present disclosure, fitment 150 is designed to cooperate with the plug 100 and plug insert 200 in plug assembly 300 through engagement with fitment bars 1020. Fitment bars 1020, in one embodiment, may comprise two vertical fitment bars 1020 on the outer wall of spout 400, sized and dimensioned to slide up and down within short recess 1006 and long recess 1010 in plug 100. In a first, pre-filling configuration, fitment bars 1020 may first engage plug 100 in short recess 1006 which terminates at short recess stopper 1008. The interaction between fitment bars 1020 and short recesses 1006 may serve as a physical barrier to maintain plug assembly 300 in a pre-filling position. Prior to filling, plug assembly 300 may be removed from spout 400. Flexible container 1100 may then be filled. Plug assembly 300 may then, in some embodiments, be rotated 90° around a central axis in order to align fitment bars 1020 with long recesses 1010. The degree of rotation may be greater or less than 90°, and rotation may be necessary only to the degree that there is sufficient separation to rotate between short recess 1006 and long recess 1010 to avoid interference between the two.

Figure 20:
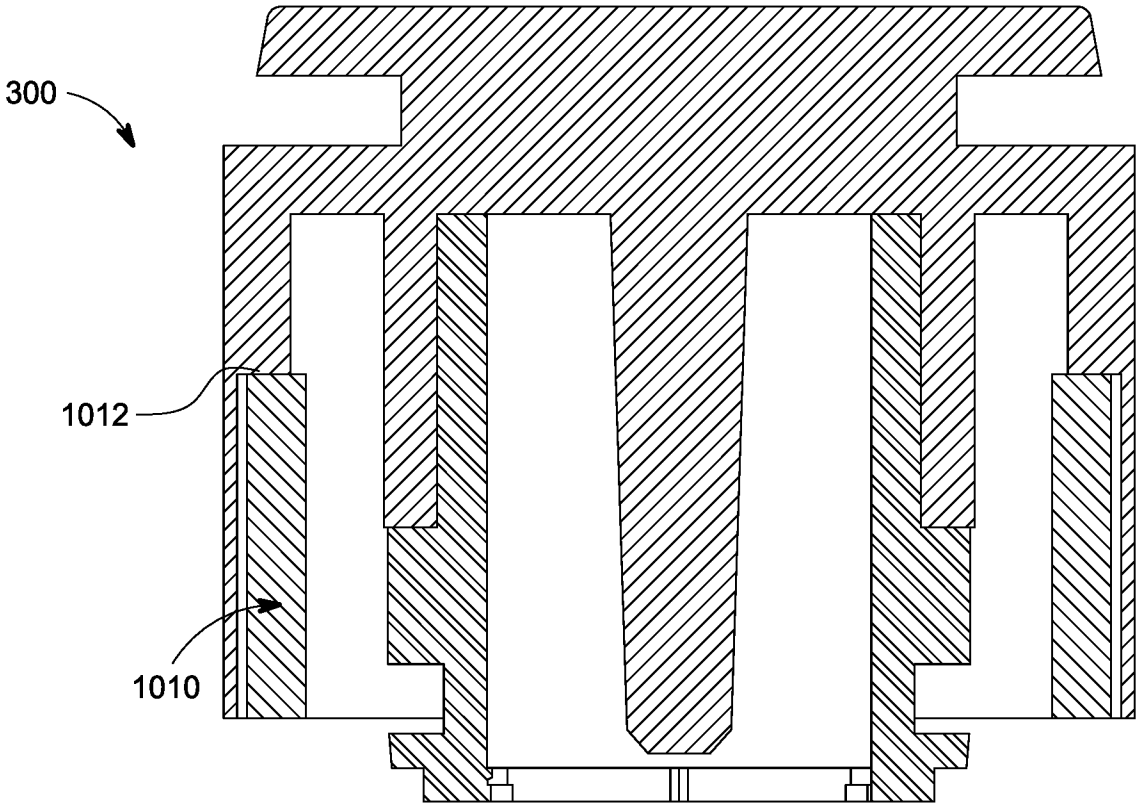
FIG. 20 is a cross sectional view of a plug assembly illustrating long recesses, in accordance with the present disclosure.

FIG. 20 shows a cross sectional view of plug assembly 300 illustrating long recesses 1010 and long recess stoppers 1012 in plug 100. Removal and rotation of plug assembly 300 may be performed by a servomechanism, as would be known to one of ordinary skill in the art. Plug assembly 300 may be replaced on spout 400 in a post-filling position where fitment bars 1020 are inserted within long recesses 1010. In the post-filling position, plug insert tabs 216 may be fixedly engaged with internal spout tabs 414. A seal, which may be provided by a friction fit, or interference fit, may be formed between spout 400 of fitment 150 and plug assembly 300 in order to maintain a sterile environment when necessary prior to and after filling.

Figure 21:
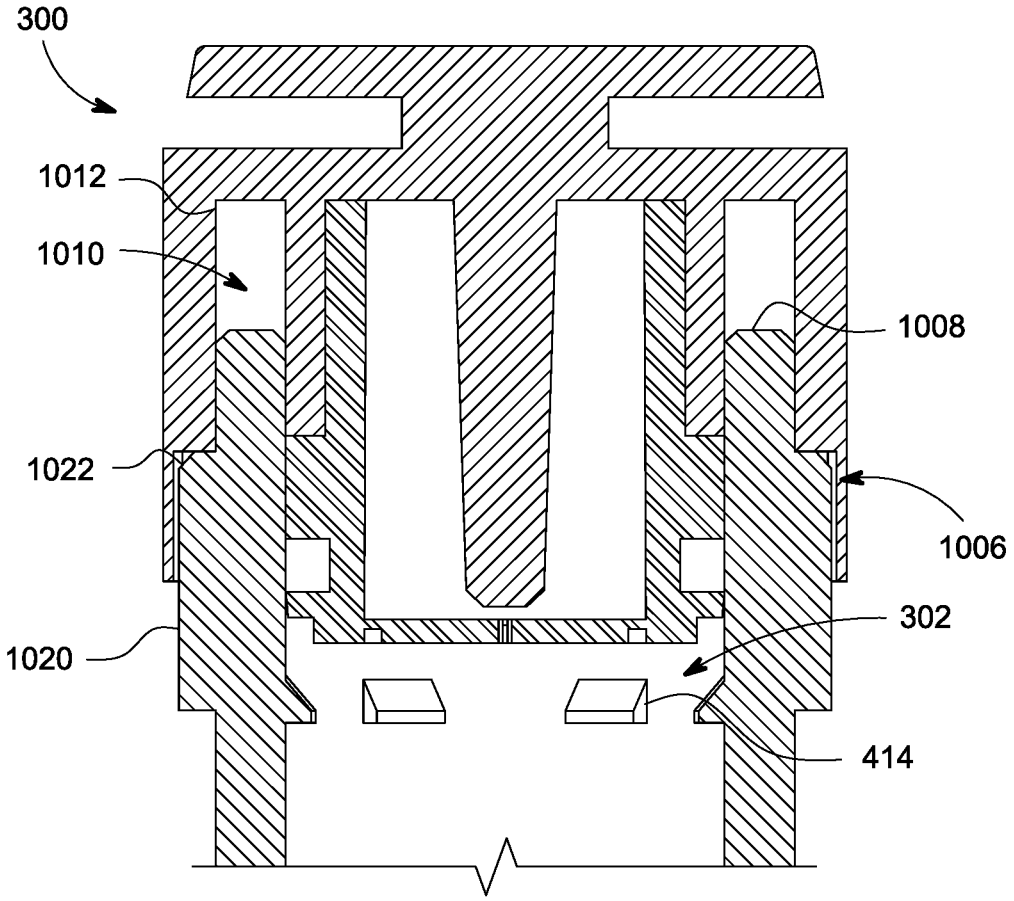
FIG. 21 is a cross sectional view of a plug assembly on a spout illustrating fitment bars positioned in short recesses in a pre-filling position, in accordance with the present disclosure.

As shown in FIG. 21, in a pre-filling position of plug assembly 300 on spout 400, plug assembly 300 is not locked into place by fixed engagement of plug insert tabs 216 with internal spout tabs 414, as evidenced by the presence of gap 302 between internal spout tabs 414 and plug insert 200. In this pre-filling placement, plug assembly 300 may be, in one embodiment, positioned on spout 400 of fitment 150 and held vertically in position within short recess 1006 by fitment bar stopper 1022 engaging short recess stopper 1008. In some embodiments, plug assembly 300 may be placed without the aid of short recesses 1006 and long recesses 1010, and a filling machine may automatically position plug assembly 300 partially down along spout 400 for a pre-filling position by a pre-set mechanism or programming mechanism for placement distance along spout 400. In this embodiment of the present disclosure, initial placement in the pre-filling position may be followed by removal of plug assembly 300 for filling of flexible container 1100, followed by fully engaged positioning of plug assembly 300 for post filling positioning by a pre-set or programmed mechanism of a filling machine. An automatic placement process may be performed with the aid of a servomechanism.

In some embodiments, a servomechanism on a filling machine may be used to position plug assembly 300 on spout 400. In general, placement of plug assembly 300 on spout 400 may be described in U.S. Pat. Nos. 9,751,677, 10,035,614, and 10,370,165, which are generally directed to aseptic plug technology, each of which is hereby incorporated by reference in its entirety. Modifications to the technology described in the '677, '614 and '165 patents are described in the present disclosure. Appropriate friction fitting, with regard to the components of the present disclosure, may be designed to prevent separation of plug 100 from plug insert 200 during pre-filling removal, as would be known to one of ordinary skill in the art.

Figure 22A:
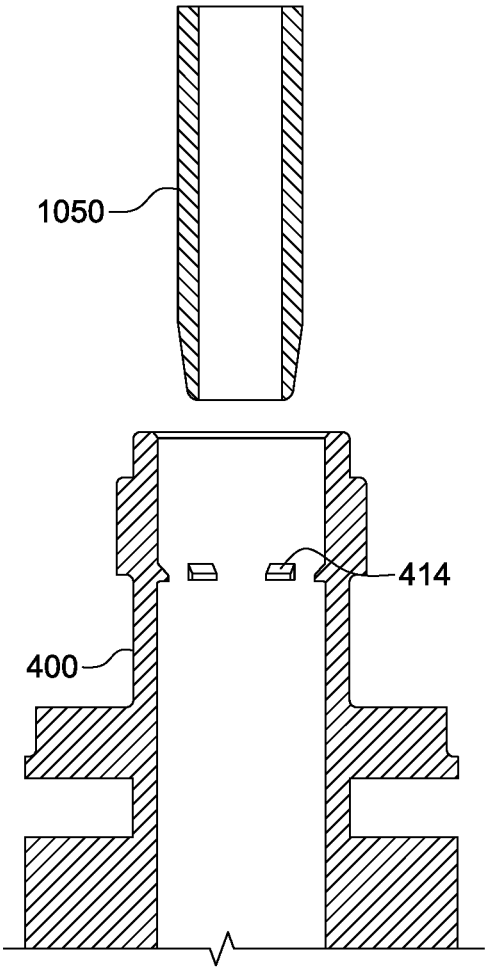
FIG. 22A is a cross sectional view of a spout and a filling tube, in accordance with the present disclosure.
Figure 22B:
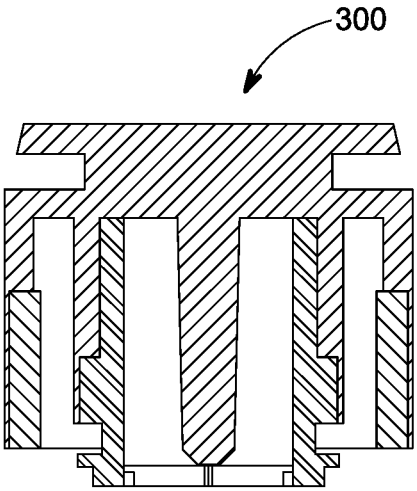
FIG. 22B is a cross sectional view of a plug assembly removed from the spout for filling, in accordance with the present disclosure.
Figure 25:
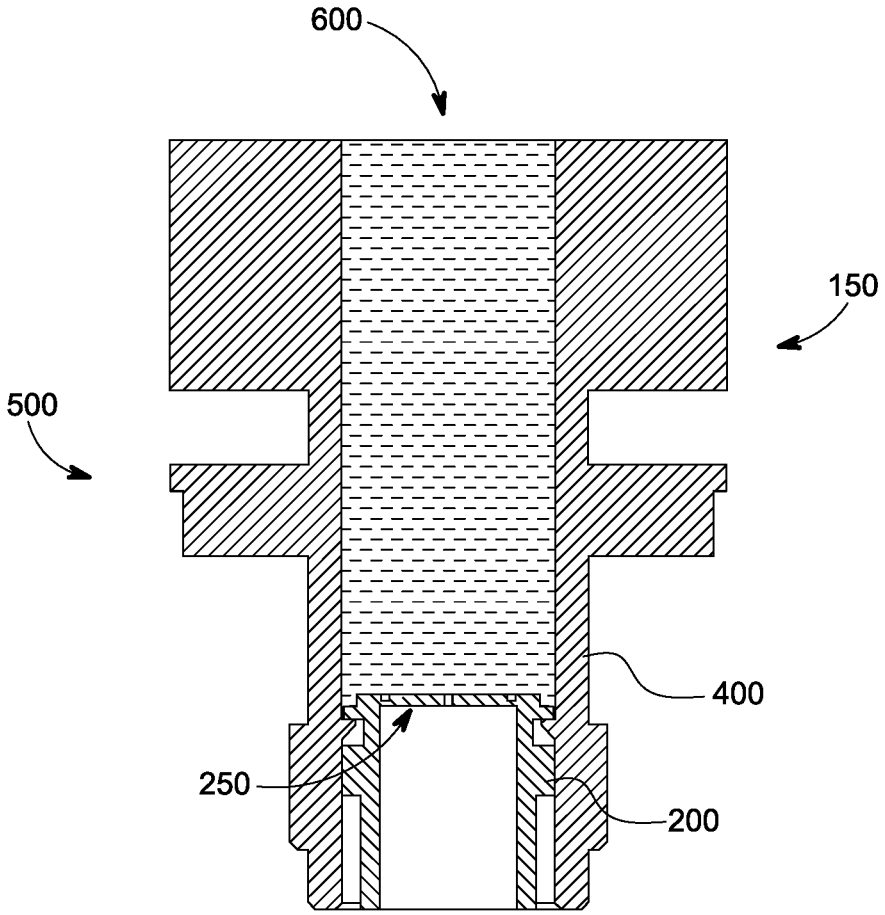
FIG. 25 is a cross sectional view of a plug insert assembly, wherein a plug insert is fixedly engaged with a spout in a post filling position, and wherein a flow inhibitor is preventing flowable material from leaking out of the plug insert, in accordance with the present disclosure.

As shown in FIGS. 22A and 22B, for filling flexible container 1100, which may be a pouch, plug assembly 300 may be removed from its pre-filling position and held by a filling machine, while filling tube 1050 may be inserted into spout 400. Flowable material 600, as shown in FIG. 25, which may be a flowable food material, may be dispensed from an aseptic filler into flexible container 1100 through spout 400 of fitment 150. Once filling is complete, filling tube 1050 is removed from fitment 150 and pouch assembly 300 may be replaced on spout 400 in a post-filling position.

Figure 23:
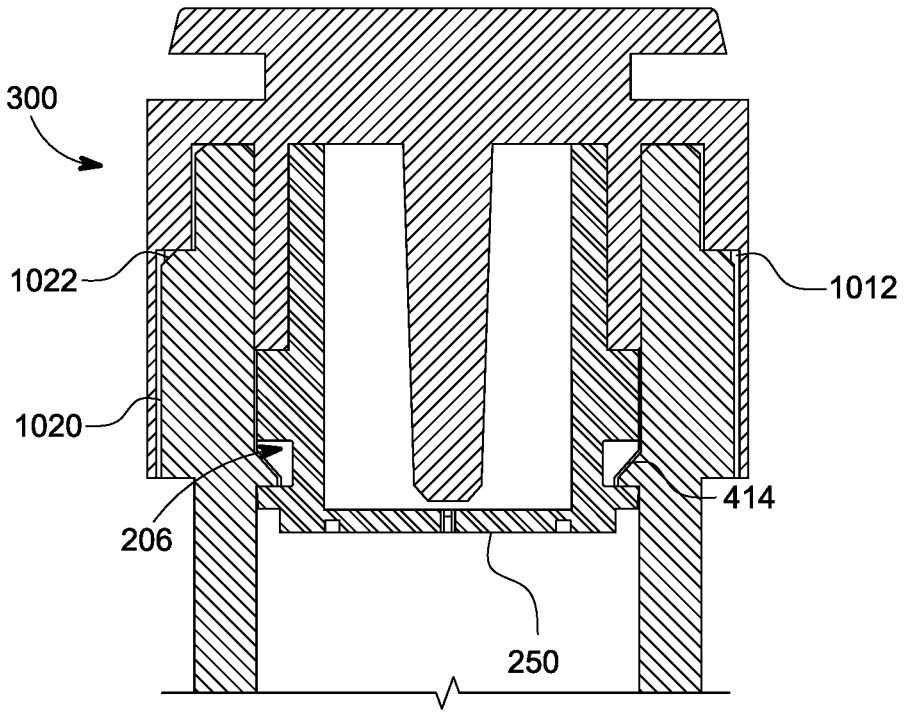
FIG. 23 is a cross sectional view of a plug assembly illustrating fitment bars positioned in long recesses and the plug assembly fixedly engaged with a spout in a post-filling position, in accordance with the present disclosure.

As shown in FIG. 23, when plug assembly 300 is replaced after filling, it is placed in a post-filling position where, in some embodiments, fitment bars 1020 are inserted into long recesses 1010. Shifting from placement of plug assembly in short recesses 1006 to long recesses 1010 may be accomplished by rotating, or otherwise aligning, plug assembly 300 after it is removed from fitment 150 for filling of the flexible container 1100. This rotation may align fitment bars 1020 with long recesses 1010 prior to plug assembly 300 being fully depressed on to fitment 150 over spout 400. Once fully depressed and placed into a final post-filling position, plug assembly 300 may be fixedly engaged to fitment 150 via at least one internal spout tab 414 designed to fixedly engage at least one plug insert tab 216 of the plug insert 200 in order to secure plug insert 200 in place after plug 100 is removed to allow dispensing of flowable material 600 by a user.

In some embodiments, internal spout tabs 414 on spout 400 may be replaced with internal recesses on spout 400, wherein complementary protruding plug insert tabs would substitute for plug insert recesses 206. This embodiment of the present disclosure may be an inversion of the tab-recess embodiment shown in FIG. 23. In this embodiment, no internal spout tabs 414 would project inward into spout 400 from the internal cylindrical wall of spout 400, thereby avoiding any potential interference with filling tube 1050 when it is inserted into spout 400 during filling, and thereby maintaining the full diameter of spout 400 throughout the entire length of spout 400.

In this embodiment, protruding plug insert tabs may first engage with an upper set of spout recesses during pre-filling placement. This upper set of spout recesses may have upper surfaces that are offset from a horizontal plane and angled toward the distal end of spout 400, relative to flexible container 1100, thereby allowing removal of plug assembly 300 for filling without disruption of the friction fit between plug 100 and plug insert 200. In some embodiments, the depth of the upper spout recesses may be slightly greater than the depth to which plug insert tabs may project into the upper spout recess, thereby preventing any weakening of the friction fit between plug insert 200 and plug 100. Further, such a configuration may avoid continual inward pressure on plug insert 200 that could exist without the presence of upper spout recesses, and the potential deformation that could result, if protruding plug insert tabs were continually compressed during pre-filling placement of plug assembly 300 and potential storage of the flexible container 1100.

In this embodiment, the upper spout recess may also have lower surfaces that are offset from a horizontal plane and may be angled toward the proximal end of spout 400, relative to the flexible container 1100, such that protruding plug insert tabs may pass through the upper spout recesses during the final, post-filling placement of plug assembly 300 after filling. Here, protruding plug insert tabs, which may have a horizontal upper surface, may lock into place within the lower spout recesses, which may have corresponding horizontal upper surfaces, thereby locking plug insert 200 into place, such that plug 100 can be separated from plug insert 200 after filling, leaving plug insert 200 and flow inhibitor 250 in place to prevent dripping or leaking during use of the flexible container 1100.

Figure 24A:
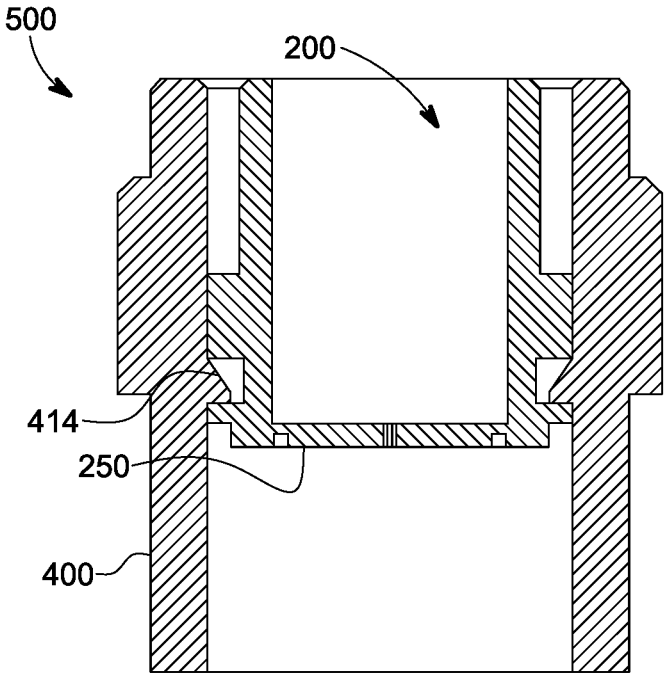
FIG. 24A is a cross sectional view of a plug insert assembly, wherein a plug insert is fixedly engaged with a spout in a post filling position after removal of a plug, in accordance with the present disclosure.
Figure 24B:
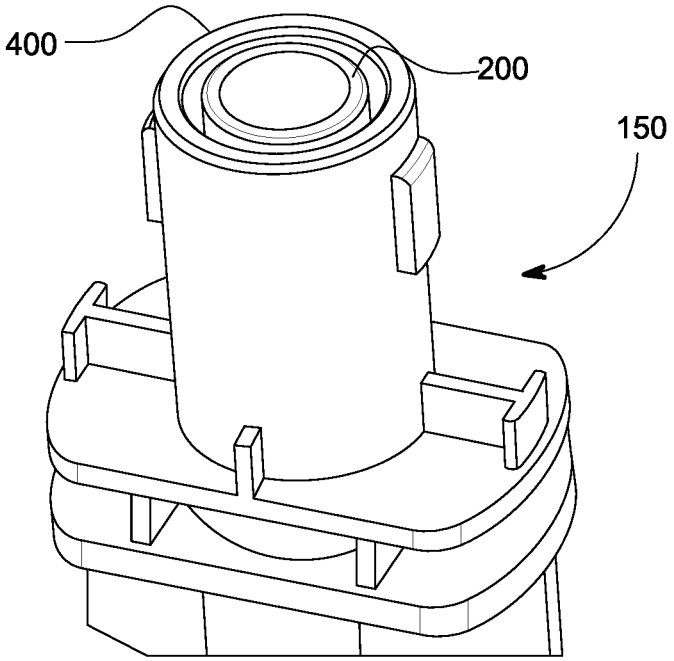
FIG. 24B is a top perspective view of a plug insert assembly, wherein a plug insert is fixedly engaged with a spout in a post filling position after removal of a plug, in accordance with the present disclosure.

FIGS. 24A and 24B show placement of plug insert 200 on spout 400 after plug 100 has been removed from spout 400, thereby forming plug insert assembly 500. After plug 100 has been removed from plug assembly 300, flowable material 600 may be dispensed from the apparatus.

FIG. 25 shows an inverted fitment 150 where flowable material 600 is held within plug insert assembly 500 and flow inhibitor 250 is preventing leakage of flowable material 600 into plug insert 200. In one embodiment, capillary energy provided by small gaps in flow inhibitor 250 may contribute to drip prevention by flow inhibitor 250. In one embodiment, squeezing of flexible container 1100 will cause flow inhibitor 250 to allow flow of flowable material into and through plug insert 200.

The amount of resistance flow inhibitor 250 has to pressure, or force, placed on flow inhibitor 250 by squeezing flexible container 1100 may be controlled to prevent unwanted flow of flowable material 600 into plug insert 200. When a target pressure is reached, flow inhibitor 250 may allow flow of flowable material 600 into plug insert 200. Flow inhibitor 250 may allow flow at targeted pressures. In some embodiments, flow inhibitor 250 may not allow flow of flowable material 600 when pressure is below a target pressure. In some embodiments, force may be applied to flexible container 1100 by squeezing from plates or rollers. In some embodiments force may be applied by hand or by machine. Resistance to pressure may, in some embodiments, be adjusted by use of different materials that may have different degrees of stiffness or flexibility, and resistance to force may also be provided by adjusting or changing a thickness of a hinge or a material comprising hinge 210 for flow inhibitor 250. In some embodiments adhesives may be used to provide resistance to pressure. In some embodiments thin, breakable links between surfaces may be used to provide resistance to pressure. In some embodiments a foil seal may be used. In some embodiments, flow inhibitor 250 may be a frangible seal. In some embodiments a burstable foil seal may be employed, wherein in some embodiments the foil may be etched. In an example embodiment, a seal for flow inhibitor 250 may be made using different approaches (e.g., heat sealing, foil sealing, sealing using glue, and the like). In some embodiments, flow inhibitor 250 may include structures and methods known to one of ordinary skill in the art, while in other embodiments flow inhibitor 250 may include structures and methods described in the present disclosure.

Figure 26:
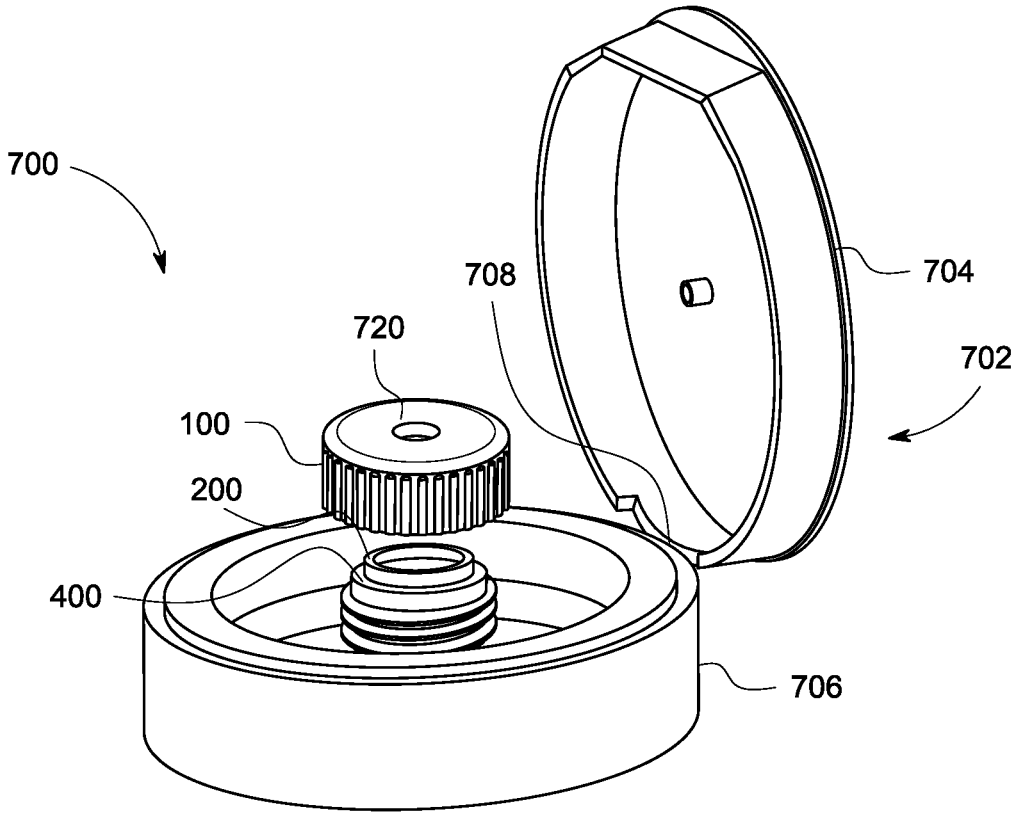
FIG. 26 is a top perspective view of a cap and a plug assembly, in accordance with the present disclosure.

FIG. 26 shows, in one embodiment of the present disclosure, plug and cap assembly 700, where plug 100 is adjacent and disconnected from plug insert 200 and spout 400. A hinged cap 702 having a lid 704 and a cap base 706 encloses plug 100 and spout 400, where lid 704 opens on a cap hinge 708 to allow access to plug 100 for removal prior to dispensing flowable material 600. In some embodiments of the present disclosure cap 702 may not be hinged and may be attached by a connector strip, or unattached, or may be attached by threaded means, or other means of attaching a cap as would be known to one of ordinary skill in the art. An exterior support surface of the cap assembly may be configured to support flexible container 1100 and delivery system and flowable material 600 in an inverted, cap-down orientation. An example of an inverted, cap-down orientation design for a flexible pouch is disclosed in U.S. Pat. No. 8,844,767, which is herein incorporated by reference in its entirety.

Figure 27A:
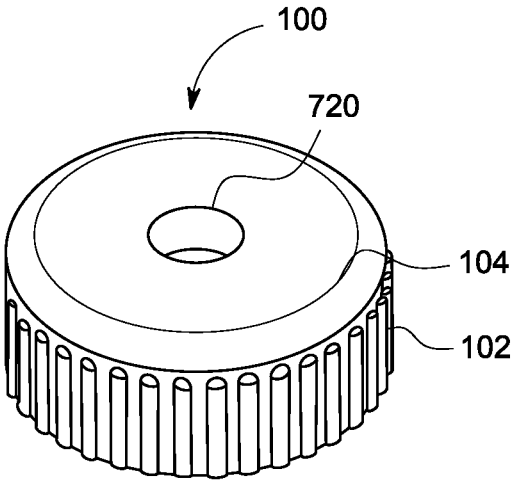
FIG. 27A is a top perspective view of a plug and plug recess, in accordance with the present disclosure.
Figure 27B:
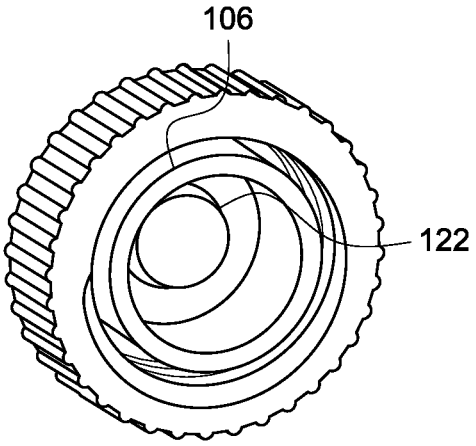
FIG. 27B is a bottom perspective view of a plug and plug shaft in accordance with the present disclosure.
Figure 27C:
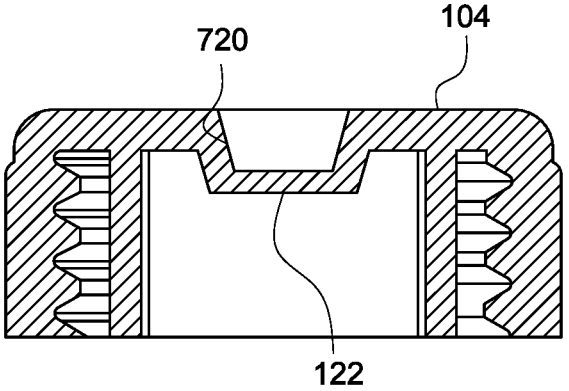
FIG. 27C is a cross sectional side view of a plug, plug shaft and plug recess, in accordance with the present disclosure.

FIGS. 27A-C show three views of an embodiment of plug 100 for use with the embodiment of the present disclosure shown in FIG. 26. Plug 100 may be cylindrical with a threaded inner portion and a knurled, or slip proof, outer plug wall 102. Inner plug wall 106 may, in some embodiments, be sized and dimensioned to secure a friction fit with plug insert 200. In this embodiment, components of plug assembly 300 may have features previously described in the present disclosure. These features may include methods of attachment previously described in the present disclosure between, for example, plug 100, plug insert 200, plug assembly 300 and spout 400, which may include threaded attachment and friction fit attachment. For example, in one embodiment, the outer surface of inner plug wall 106 may be sized and dimensioned to form a friction fit seal against an inner surface of spout neck 402.

Figure 28A:
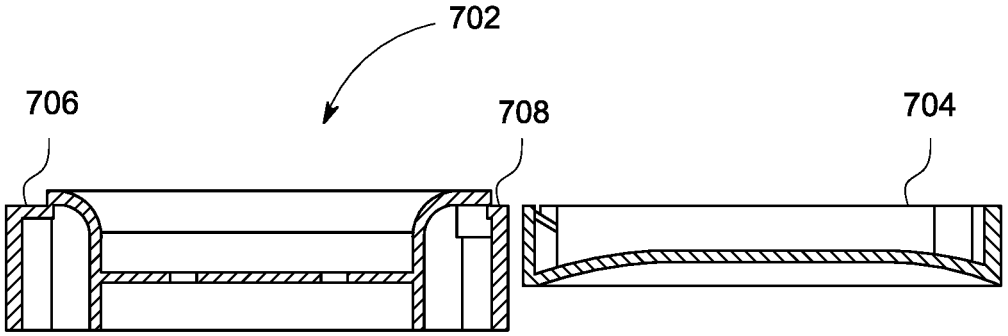
FIG. 28A is a cross sectional side view of a cap.
Figure 28B:
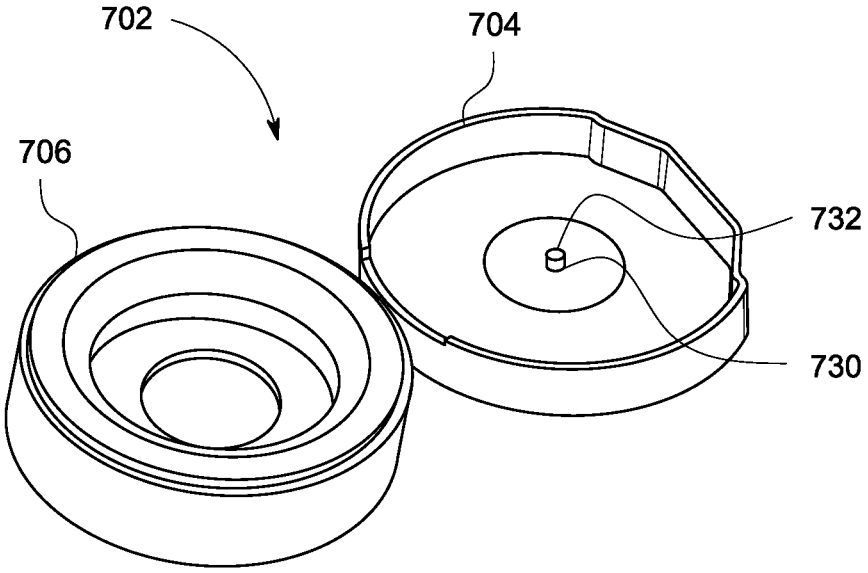
FIG. 28B is a top perspective view of the cap, in accordance with the present disclosure.

For an embodiment of the present disclosure that includes hinged cap 702, as shown in FIG. 26, plug 100 may include a plug recess 720, as shown in FIG. 27A, in which cap shaft 730, as shown in FIG. 28B, may be positioned. Hinged cap 702 may be secured to fitment 150 by means as would be known to one of ordinary skill in the art, and, in some embodiments, hinged cap 702 may be designed to snap connect to fitment 150. Cap shaft 730, having cap shaft end 732, may be configured to fit within plug recess 720 when hinged cap 702 is in a closed position. FIG. 27B shows a bottom perspective view of plug 100, where plug shaft 122 may be positioned on the upper, inner portion of plug 100. Plug shaft may be cylindrical, conical, rectangular or any size and shape sufficient to prevent opening of flow inhibitor 250 in one direction when hinged cap 702 is in a closed position after plug 100 has been removed and the position of plug insert 200 has been shifted in a distal direction due to application of a force on plug insert 200 in a distal direction.

Figure 30:
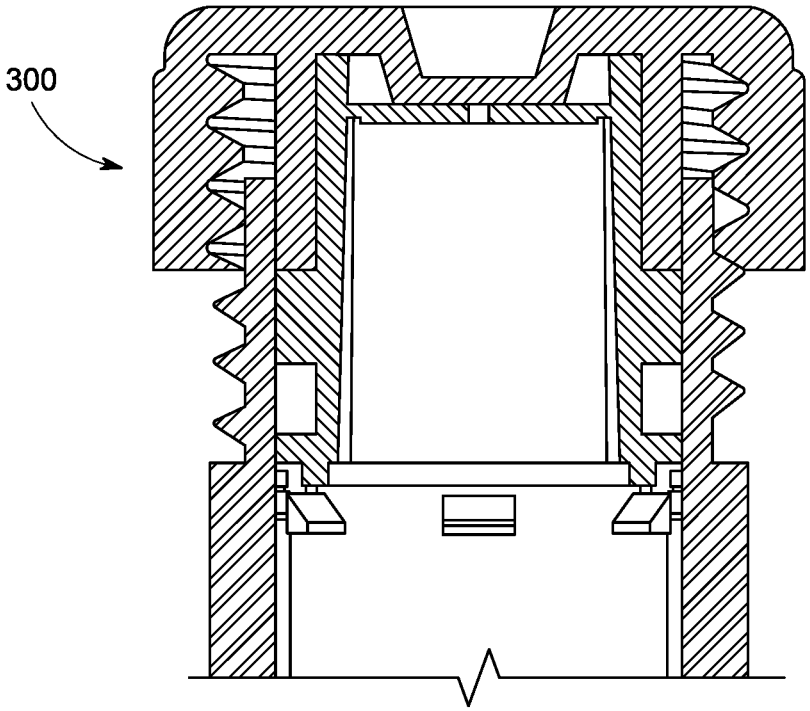
FIG. 30 is a cross sectional view of a plug assembly in a pre-filling position on a spout, in accordance with the present disclosure.

As shown in FIG. 27C, plug shaft 122 may depend downwardly from top plug wall 104 to engage flow inhibitor 250 when plug insert 200 is inserted into plug 100 (as shown in FIGS. 3 and 30). Flow inhibitor 250 may, in some embodiments, be a valve, which may be a star valve, and may be comprised of plastic, silicon, or other suitable material. In some embodiments, flow inhibitor may be a baffle. Plug shaft 122 may, in some embodiments, be designed to prevent flexing of flow inhibitor 250, where flow inhibitor 250 may be a star valve or a baffle.

In some embodiments, including embodiments related to the embodiment shown in FIG. 26, plug 100 may have a break-away band, as might be found on a plastic cap for milk or an aluminum cap for beverages, that may lock to provide tamper evidence when plug 100 is placed on spout 400 in a post-filling position. Other types of tamper-evident bands or security rings, as well as other methods of identifying tampering, may be used in conjunction with plug 100, as would be known to one of ordinary skill in the art.

FIGS. 28A and 28B show hinged cap 702 in an open position. Hinged cap 702 may include lid 704, which may include cap shaft 730 having cap shaft end 732, and cap base 706. Cap shaft 730 may be adapted to fit into plug recess 720 positioned on an upper surface of plug 100 when hinged cap 702 is in a closed position.

Figure 29:
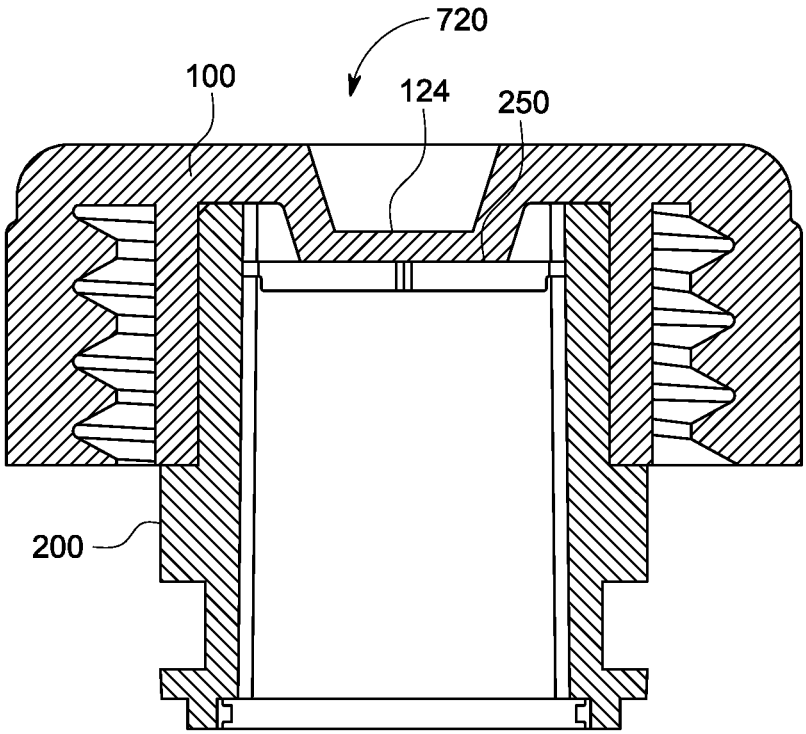
FIG. 29 is a cross sectional side view of a plug assembly, in accordance with the present disclosure.
Figure 35:
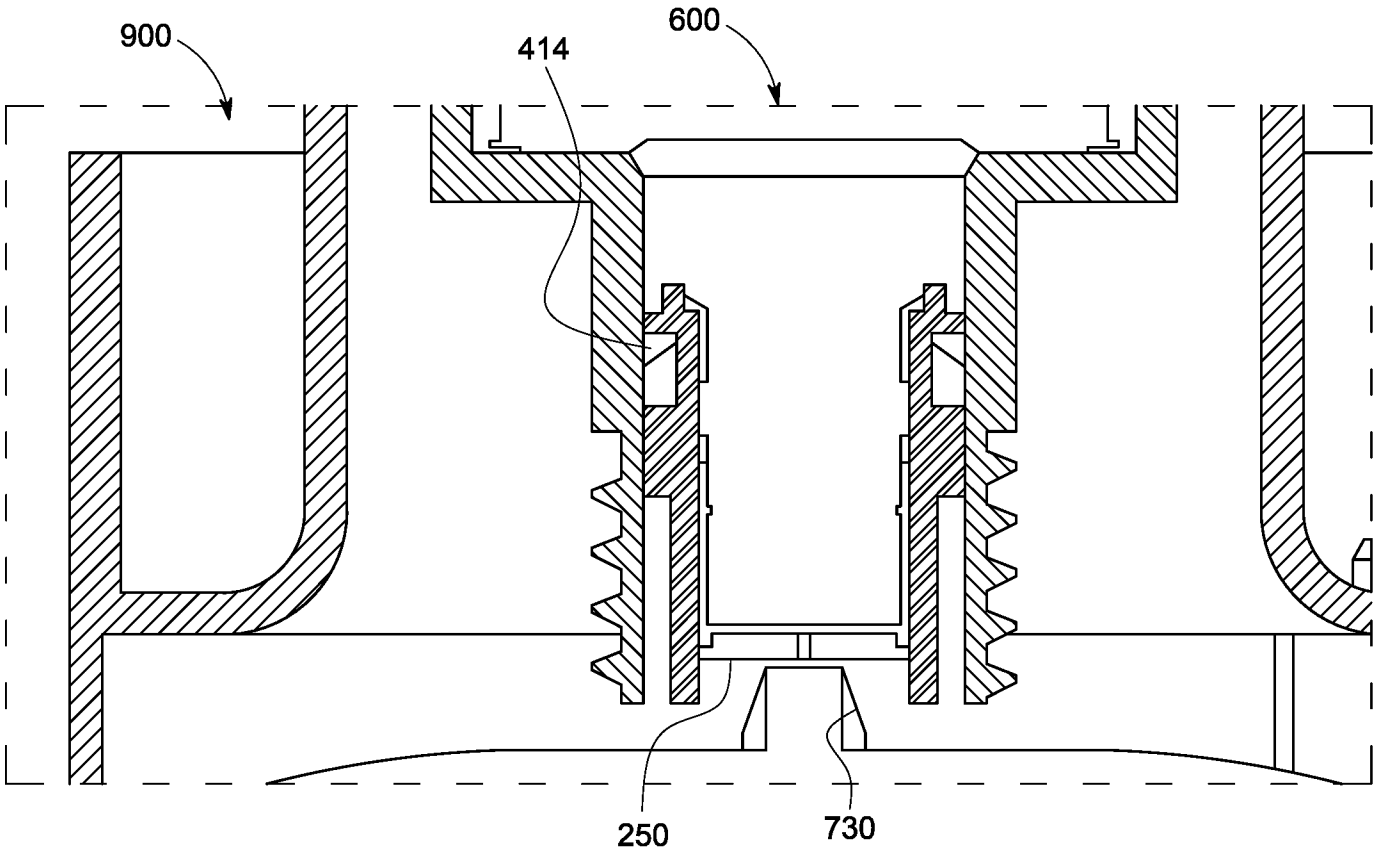
FIG. 35 shows a plug insert and cap assembly, where a plug has been removed for dispensing of flowable material and the plug insert is in a distal second position, in accordance with the present disclosure.

As shown in FIG. 29, plug recess 720, in some embodiments, may be integral with plug shaft 122. Fitting cap shaft 730 into plug recess 720 may allow for cap shaft 730 to depend downwardly and engage flow inhibitor 250 when plug 100 is removed and discarded after filling, as shown in FIG. 35 and further described below.

FIG. 30 shows plug assembly 300 in a pre-filling position on spout 400. In one embodiment of the present disclosure, plug assembly 300 may be positioned on spout 400 with a threaded, screw cap mechanism, as shown in FIG. 30. In some embodiments of the present disclosure, predetermined frictional forces may be utilized to maintain proper positioning of plug assembly 300, where appropriate seals are maintained in order to maintain an aseptic environment in the container throughout the filling process. It should be understood that automated assembly and filling equipment may be calibrated to maintain such positioning within a tight tolerance, as would be known by one of ordinary skill in the art.

Figure 31B:
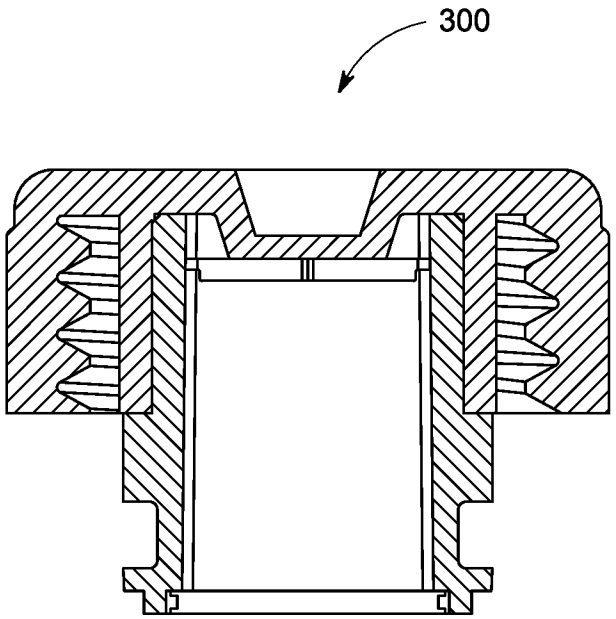
FIG. 31B is a cross sectional view of a plug assembly removed from the spout for filling, in accordance with the present disclosure.
Figure 31A:
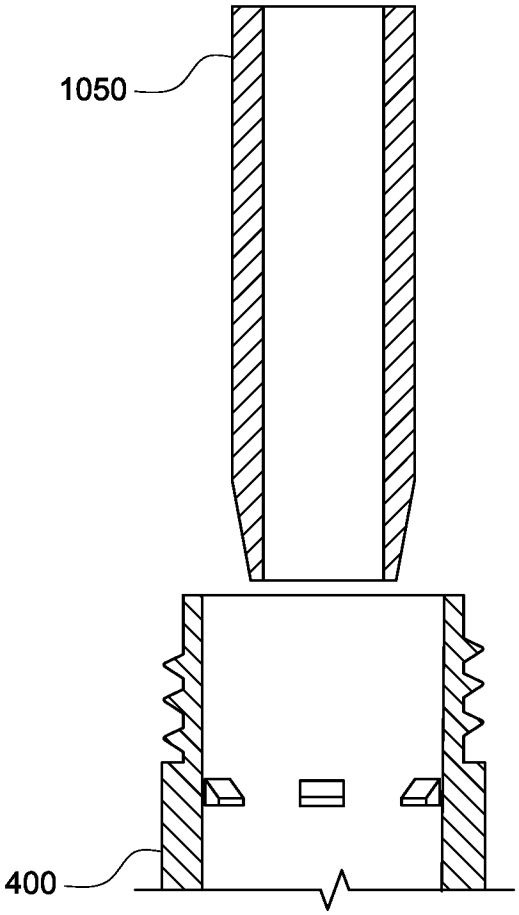
FIG. 31A is a cross sectional view of a spout and a filling tube, in accordance with the present disclosure.

FIG. 31A shows plug assembly attached to spout 400. FIG. 31B shows plug assembly removed from spout 400 where spout 400 is in a position for filling by filling tube 1050. FIGS. 31A and 31B show liquid or semi-liquid product filling tube 1050, placed adjacent to spout 400 after removal of plug assembly 300. The filling process may take place in a sterile zone of the filling equipment.

Figure 32:
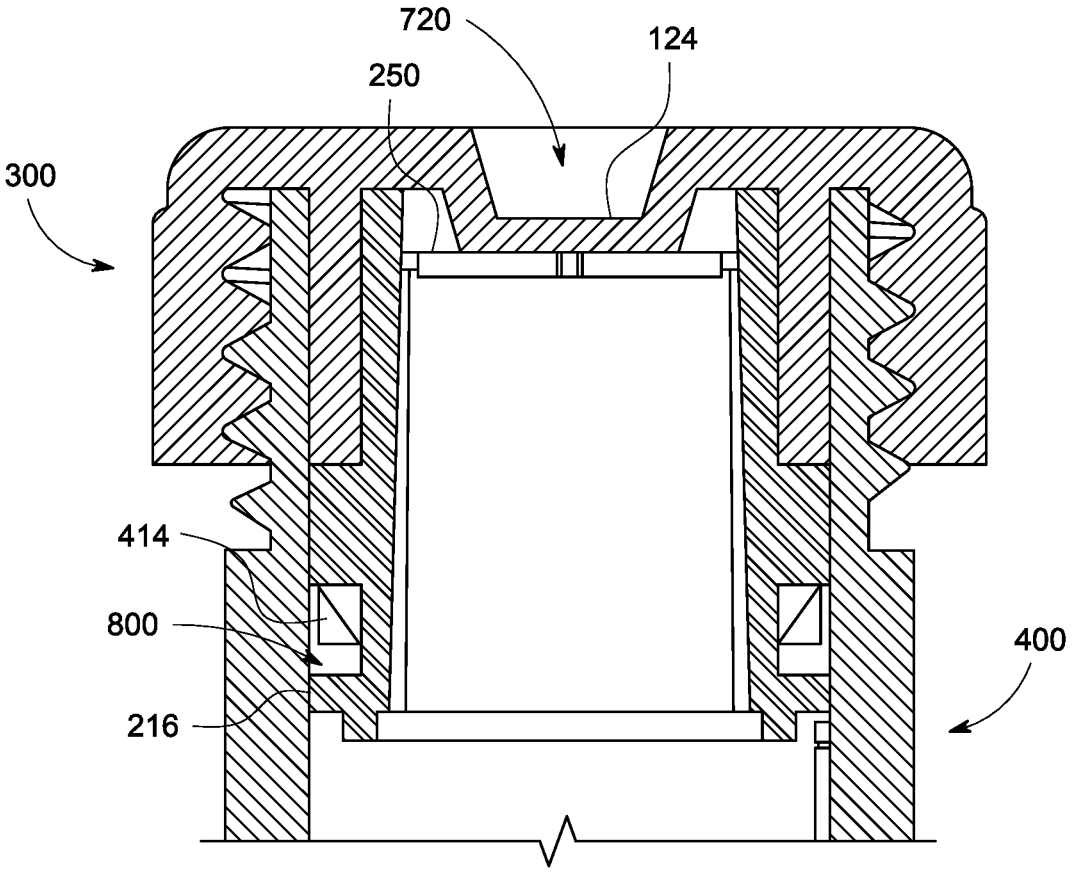
FIG. 32 is a cross sectional view of a plug assembly in a post-filling position on a spout showing a buffer zone and a plug recess, wherein a plug insert is shown in a proximal first position, in accordance with the present disclosure.

FIG. 32 shows plug assembly in a post-filling position on spout 400. When plug 100 is removed for dispensing of flowable material 600 by a user, a space between cap shaft end 732 and flow inhibitor 250 may be eliminated by the existence of buffer zone 800 between internal spout tabs 414 and a bottom, proximal end of plug insert recess 206, where plug insert tabs 216 are shown in a post filling position of plug assembly 300. In some embodiments, as shown in FIG. 32, plug insert tabs 216 may not, initially, after post filling placement of plug assembly 300, engage with internal spout tabs 414. Buffer zone 800 may separate internal spout tabs 414 and plug insert tabs 216 prior to removal of plug 100 by a user and dispensing of flowable material 600.

Figure 33:
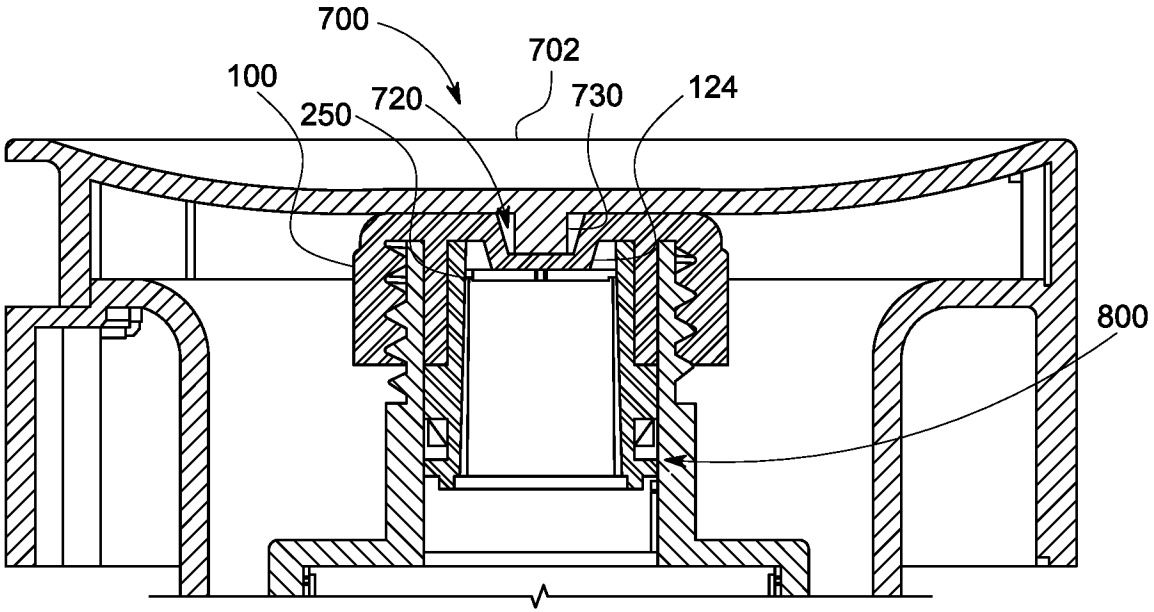
FIG. 33 is a cross sectional view of a plug assembly in a post-filling position on a spout, wherein a plug insert is shown in a proximal first position and a cap is in a closed position, in accordance with the present disclosure.

FIG. 33 shows plug and cap assembly including buffer zone 800. Hinged cap 702 is shown in a closed position where cap shaft 730 is positioned in plug recess 720 within plug shaft 122. When plug assembly 300 is combined with hinged cap 702 to form plug and cap assembly 700, and hinged cap 702 is in a closed position, the distance between flow inhibitor 250 and cap shaft end 732 may, in some embodiments of the present disclosure, be the thickness of plug shaft end 124. In some embodiments, this distance may be measured from the bottom of plug recess 720 to the outer, or proximal, surface of flow inhibitor 250, when plug shaft end 124 engages flow inhibitor 250 to prevent inadvertent dispensing of flowable material 600. Cap shaft 730 and plug shaft 122 may have respective diameters of a width substantial enough to prevent flow inhibitor 250 from opening or dispensing flowable material 600 when engaged with the proximal end of plug shaft 122 or cap shaft 730.

In some embodiments, cap shaft 730, plug shaft 122 and plug recess 720 may be configured such that when plug 100 is removed, and may be discarded, cap shaft 730 and spout 400 form a substantial or partial seal to minimize or prevent air flow into spout 400 and thereby prevent drying and solidification of flowable material 600, which could result in blockage of spout 400 and impede dispensing of flowable material 600 by a user. In some versions of this embodiment, a seal extension extending downwardly from the inner surface of lid 704 may be ring shaped, and may be shaped and sized to fit around or within spout 400, thereby forming a seal, while in another embodiment a seal extension may be cylindrical and be configured to fit within spout 400. A seal extension, as contemplated within the scope of the present disclosure, may be integral with cap shaft 732 or may be separated from cap shaft 732. A seal extension may be comprised of flexible material, such as plastic, rubber or silicone. In some embodiments, plug recess 720 may have multiple recesses configured to accept both a seal extension and cap shaft 732. In some embodiments of the present disclosure, plug recess 720 may have a single plug recess of a diameter having a width capable of accepting both the seal, which may be ring shaped, and a centrally located cap shaft 732 or multiple plug recesses.

Figure 34:
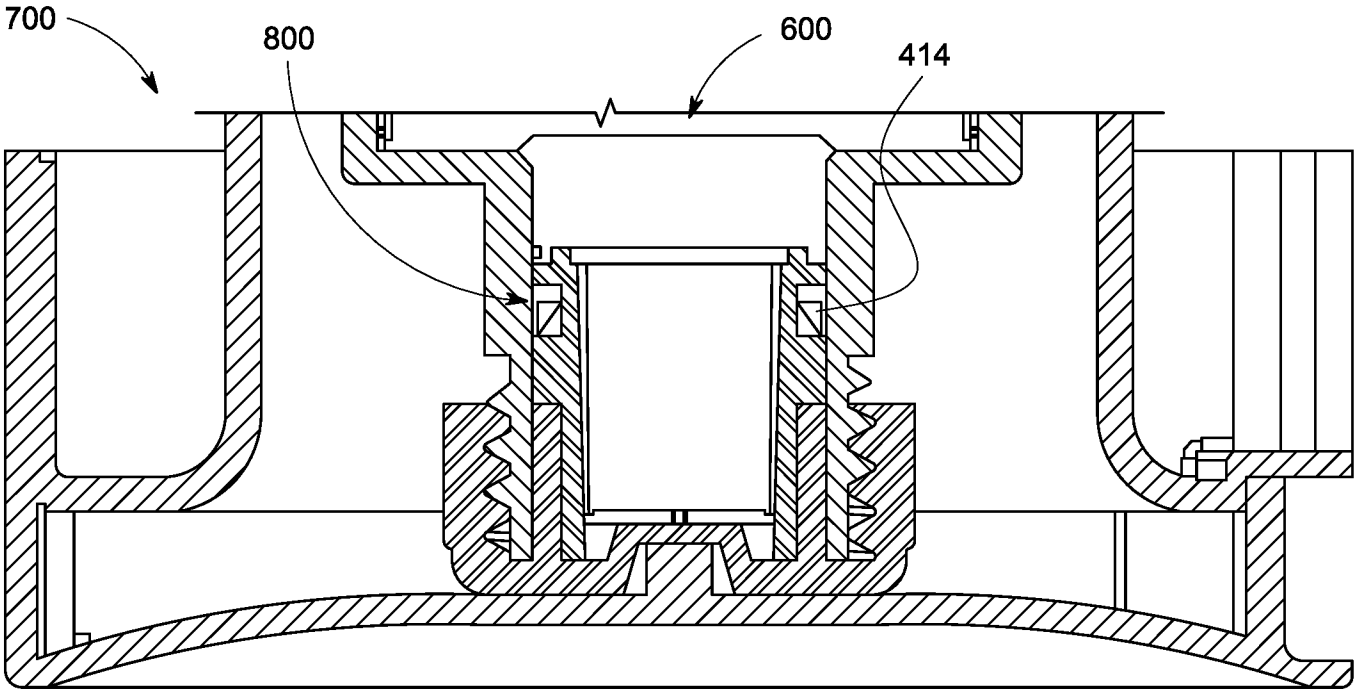
FIG. 34 is a magnified cross sectional view of a plug assembly in a post-filling position on a spout showing a buffer zone, wherein a plug insert is shown in a proximal first position and a cap is in a closed position, in accordance with the present disclosure.

FIG. 34 shows plug and cap assembly 300. Buffer zone 800 is shown between internal spout tabs 414 and plug insert tabs 216. Hinged cap 702 is in a closed position wherein cap shaft 730 is situated in plug recess 720.

FIG. 35 shows plug insert and cap assembly 900, where plug 100 has been removed for dispensing of flowable material 600. Buffer zone 800 between internal spout tabs 414 and plug insert tabs 216 on spout 400 has been eliminated as plug 100 has been removed and where gravity or pressure from flowable material 600 may be pushing plug insert 200 in a distal, or dispensing, direction toward the outlet of spout 400. Wherein the plug insert recess may be a buffer zone 800 having a height greater than a height of the plug insert tab such that the plug insert tab can move from a proximal first position to a distal second position when the plug is removed and a force is applied on the plug insert 200 in a distal direction. Hinged cap 702 is shown in a closed position where cap shaft 730 is positioned adjacent and engaged with flow inhibitor 250 as plug insert 200 has shifted in a distal direction due to the removal of plug 100 and a force applied in a distal direction to plug insert 200 such that internal spout tabs 414 and plug insert tabs 216 are engaged. In some embodiments, plug insert 200 may be pushed or pulled in a distal direction to align with cap shaft 730 such that cap shaft 730 engages flow inhibitor 250, which may be a star valve, to ensure flowable material 600 does not drip while the flexible package is stored in an inverted position.

A distance between the bottom of plug recess 720 and the outer portion of flow inhibitor 250 that exists when plug 100 is in place in plug assembly 300 may, in some embodiments, be approximately equal to the distance of buffer zone 800. This distance may be eliminated by the removal of plug 100 and application of a force to shift plug insert 200 in a distal direction for the dispensing of flowable material 600. The shift of plug insert 200 in a distal direction may allow for cap shaft end 732 of cap shaft 730 to engage with flow inhibitor 250 to prevent inadvertent dispensing of product after plug 100 has been removed and hinged cap 702 is in a closed position. When hinged cap 702 is in an open position in cap and plug insert assembly 900, and pressure applied to flowable material 600, flow inhibitor 250, or star-shaped leaves of star valve 250, may open downward, or outward, for dispensing of flowable material 600.

Figure 36:
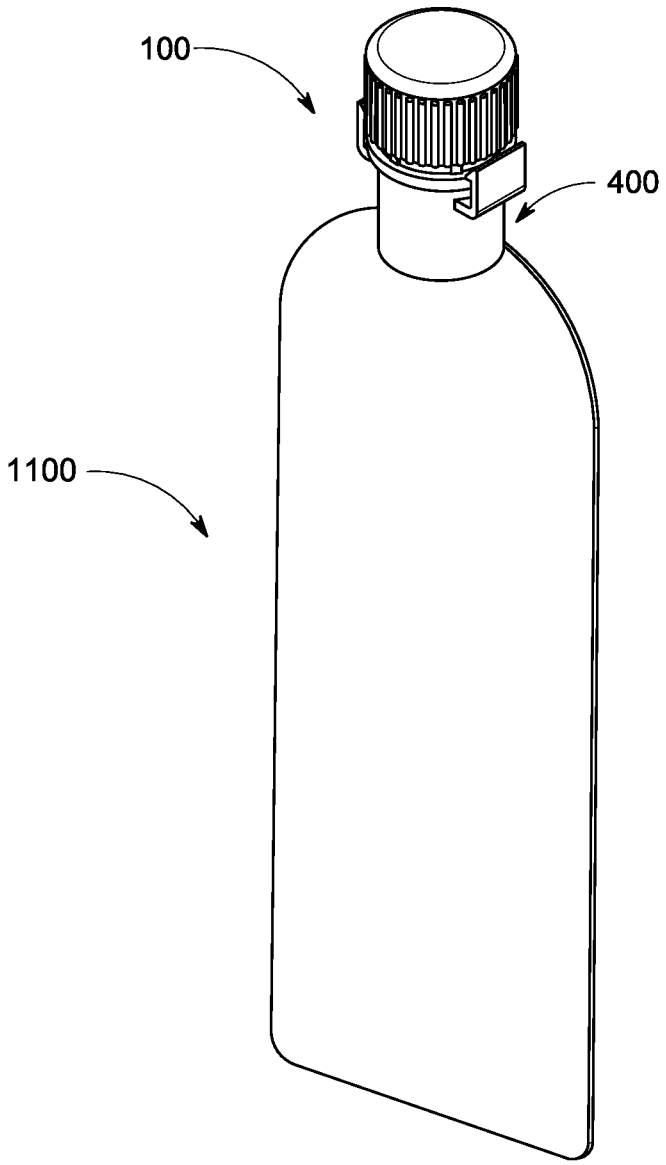
FIG. 36 is a top perspective view of a flexible container, a spout and a plug, in accordance with the present disclosure.

FIG. 36 shows flexible container 1100, spout 400 and plug 100. In this embodiment, flexible container 1100 is a pouch. In some embodiments of the present disclosure, a method for filling a flexible container 1100, which may be an aseptic pouch, comprises the steps of: providing a flexible container 1100, the flexible container 1100 including a body having a plurality of panels that are coupled together to define a cavity, and, spout 400 providing ingress into the cavity, spout 400 having plug assembly 300 sealingly engaged to spout 400 in a pre-filling position, partially depressed along spout 400, thereby precluding access into the cavity, wherein plug assembly 300 may be comprised of two parts, plug 100 and plug insert 200, wherein plug insert 200, which may include flow inhibitor 250 to prevent flow of a flowable material 600, is inserted into plug 100 prior to engaging plug assembly 300 with spout 400; cleaning the external surfaces of the flexible container 1100; directing spout 400 and plug assembly 300 into an aseptic zone, the aseptic zone having a supply of sterilized gas having a positive flow within the aseptic zone; removing plug assembly 300; filling flexible container 1100 with flowable material 600; replacing plug assembly 300 on spout 400 to seal flexible container 1100 by fully depressing plug assembly 300 along spout 400 such that plug insert 200 fixedly engages spout 400; removing spout 400 and plug assembly 300 from the aseptic zone; removing plug 100 from spout 400; and, leaving plug insert 200 in place within the spout, forming plug insert assembly 500 and providing access to the cavity through flow inhibitor 250, which may, in some embodiments, be a hinged baffle or a valve. In some embodiments, before plug 100 is removed from spout 400, plug 100 may be coupled to a cap, and the cap to spout 400, whereupon removal of the cap removes plug 100. Some elements of methods and structures described herein may be found in U.S. Pat. No. 10,035,614, which is hereby incorporated by reference in its entirety.

In some embodiments, the step of coupling plug 100 to a cap further comprises the step of rotatably coupling the cap to spout 400. In some configurations, the step of providing flexible container 1100 further comprises the step of pre-sterilizing the cavity. In some embodiments, a flexible container 1100 may be sterilized through at least one of gamma, x-ray and e-beam radiation, or other ionizing radiation, prior to placement within the flexible container 1100 filler machine.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An apparatus, comprising:

a plug assembly attachable to a spout;

wherein the plug assembly comprises a plug and a plug insert;

wherein the plug includes a top plug wall, an outer plug wall and an inner plug wall;

wherein the outer plug wall and the inner plug wall depend downwardly from the top plug wall;

wherein the plug insert is adapted to be sealably attached to the plug;

wherein the plug insert comprises a plug insert body and a means for inhibiting a flow of a flowable material through the spout;

wherein the plug insert body comprises, a distal plug insert portion, a central plug insert portion, and a proximal plug insert portion;

wherein the distal plug insert portion is in sealable contact with the inner plug wall;

where the central plug insert portion extends in a vertical plane between the inner plug wall and at least one plug insert recess;

wherein the proximal plug insert portion comprises the at least one plug insert recess and at least one plug insert tab; and wherein the at least one plug insert tab is adapted to engage at least one internal spout tab when the at least one internal spout tab is positioned within the at least one plug insert recess in order to retain the plug insert in the spout when the plug is separated from the plug insert;

a cap coupled to a fitment and comprising a lid, a cap base, and a support surface to support a container in an inverted cap-down orientation;

wherein the cap encloses the plug assembly when the lid is in a closed position;

wherein the lid comprises a cap shaft on an inner side of the lid configured to insert into a plug recess on an upper side of the plug when the lid is in the closed position;

wherein the plug has a plug shaft;

wherein the plug recess is located within the plug shaft and the cap shaft is configured to be inserted into the plug recess;

wherein the plug shaft has a plug shaft end configured to engage with the means for inhibiting the flow of the flowable material through the spout;

wherein the plug insert recess is a buffer zone and has a height greater than a height of the plug insert tab such that the plug insert tab can move from a proximal first position to a distal second position when the plug is removed and a force is applied on the plug insert in a distal direction; and wherein the cap shaft is configured to engage the means for inhibiting the flow of the flowable material through the spout when the plug insert is in the second distal position and the hinged cap is in the closed position.

2. The apparatus of claim 1, wherein an inner surface of the outer plug wall and the spout comprise threads for removably attaching the plug assembly to the spout.

3. The apparatus of claim 1, wherein an inner surface of the outer plug wall and the spout comprise a friction fit for removably attaching the plug assembly to the spout.

4. The apparatus of claim 1, wherein the plug insert recess has a lesser width than the central plug insert portion.

5. The apparatus of claim 1, wherein the outer wall of the plug is knurled to facilitate gripping.

6. An apparatus, comprising:

a plug assembly removably and sealably attachable to a spout;

wherein the plug assembly comprises a plug and a plug insert;

wherein the plug insert is adapted to be attached to the plug;

wherein the plug insert comprises a plug insert body adapted to be removably attached to the plug and a means for inhibiting a flow of a flowable material through the spout; and wherein the plug insert and the spout comprise a means for engaging in order to retain the plug insert in the spout when the plug is separated from the plug insert;

a cap coupled to a fitment and comprising a lid and a cap base;

wherein the lid comprises a cap shaft on an inner side of the lid configured to insert into a plug recess on an upper side of the plug when the lid is in a closed position;

wherein the plug has a plug shaft;

wherein the plug recess is located within the plug shaft and the cap shaft is configured to be inserted into the plug recess;

wherein the plug shaft has a plug shaft end configured to engage with the means for inhibiting the flow of the flowable material through the spout;

wherein a plug insert recess comprises a buffer zone and has a height greater than a height of a plug insert tab such that the plug insert tab can move from a proximal first position to a distal second position when the plug is removed and a force is applied on the plug insert in a distal direction; and wherein the cap shaft is configured to engage the means for inhibiting the flow of the flowable material through the spout when the plug insert is in the second distal position and the cap is in the closed position.

7. The apparatus of claim 6, wherein the cap is a hinged cap.

8. The apparatus of claim 6, wherein the plug includes a top plug wall, an outer plug wall and an inner plug wall;

wherein the outer plug wall and the inner plug wall depend downwardly from the top plug wall;

wherein the plug insert body comprises, a distal plug insert portion, a central plug insert portion, and a proximal plug insert portion;

wherein the distal plug insert portion is in sealable contact with the inner plug wall; and wherein the central plug insert portion extends in a vertical plane between the inner plug wall and at least one plug insert recess.

9. The apparatus of claim 8, wherein the proximal plug insert portion comprises the at least one plug insert recess and at least one plug insert tab; and wherein the at least one plug insert tab is adapted to engage at least one internal spout tab when the at least one internal spout tab is situated within the at least one plug insert recess.

10. The apparatus of claim 6, wherein an engagement means between the plug insert and the spout is a male-female connector.

11. The apparatus of claim 6, wherein the plug insert and the spout are axial and the plug insert is sized and shaped to fit within the spout.

12. The apparatus of claim 6, wherein the means for inhibiting the flow of the flowable material through the spout is a one-way hinged baffle that opens in a distal direction.

13. The apparatus of claim 6, wherein the means for inhibiting the flow of the flowable material through the spout is a valve.

14. The apparatus of claim 6, wherein the means for inhibiting the flow of the flowable material through the spout is at least one of a one-way hinged baffle and a valve, and wherein the at least one of the hinged baffle and the valve is adjacent a plug shaft prior to the plug being separated from the plug insert to prevent leakage of the flowable material.

15. The apparatus of claim 6, wherein the cap is a hinged cap.

16. The apparatus of claim 6, wherein the cap comprises a support surface to support a container in an inverted cap-down orientation.

17. The apparatus of claim 6, wherein the cap encloses the plug assembly when the cap is in a closed position.

18. A method, comprising:

removably inserting a plug assembly into a spout;

wherein the plug assembly comprises a plug and a plug insert;

removing the plug assembly from the spout;

filling a container with a flowable material through the spout;

irremovably inserting the plug assembly into the spout; and removing the plug from the spout while the plug insert remains in the spout;

applying a force to the plug insert in a distal direction;

shifting the plug insert from a proximal first position to a distal second position;

engaging a flow inhibitor with a cap shaft to prevent unintended flow of material through the flow inhibitor when a cap is in a closed position.

19. The method of claim 18, wherein the plug assembly is inserted a first time into a pre-filling position wherein at least one plug insert tab does not engage at least one internal spout tab; and wherein the plug assembly is inserted a second time into a post-filling position where the at least one plug insert tab engages the at least one internal spout tab.

20. The method of claim 19, further comprising guiding positioning of the plug assembly into the pre-filling position by including at least one short recess in an outer plug wall;

guiding positioning of the plug assembly into the post-filling position by including at least one long recess in the outer plug wall; and wherein the at least one short recess and the at least one long recess are adapted to engage at least one fitment bar on a fitment.

21. The method of claim 18, wherein the plug insert includes at least one of a baffle and a valve.

22. The method of claim 18, further comprising capping the plug prior to removing the plug from the spout.

23. The method of claim 18, wherein the method is aseptic.

* * * * *